US006703774B2

(12) United States Patent
Reyal

(10) Patent No.: US 6,703,774 B2
(45) Date of Patent: Mar. 9, 2004

(54) SHADOW MASK SUPPORT FRAME FOR A CATHODE RAY TUBE

(75) Inventor: Jean-Pierre Reyal, Eragny (FR)

(73) Assignee: Imphy Ugine Precision, Puteaux (FR)

( * ) Notice: Subject to any disclaimer, the term of this patent is extended or adjusted under 35 U.S.C. 154(b) by 0 days.

(21) Appl. No.: 10/109,862

(22) Filed: Apr. 1, 2002

(65) Prior Publication Data

US 2002/0140355 A1 Oct. 3, 2002

(51) Int. Cl.[7] ..... H01J 29/80
(52) U.S. Cl. ..... 313/407
(58) Field of Search ..... 315/1, 364; 313/402, 313/403, 404, 405, 406, 407, 408

(56) References Cited

U.S. PATENT DOCUMENTS 5,956,101 A * 9/1999 Yang ..... 348/843
6,064,146 A * 5/2000 Lee ..... 313/407
6,420,823 B1 * 7/2002 Tanaka ..... 313/402
6,479,925 B1 * 11/2002 Kim ..... 313/402

* cited by examiner

*Primary Examiner*—Don Wong
*Assistant Examiner*—Minh D A
(74) *Attorney, Agent, or Firm*—Sughrue Mion, PLLC

(57) ABSTRACT

A shadow mask support frame for a color cathode ray tube has a rectangular shape overall comprises two end uprights and two lateral uprights. The lateral uprights have a straight main part and two end parts each connected by at least one joining portion to an end upright. The lateral uprights have axes parallel to each other situated in a plane parallel to a reference plane of the frame. Each of the joining portions is in contact through a lateral face with an internal face of a substantially flat wall perpendicular to the reference plane of the frame, so that the end uprights of the frame are in abutment on the joining portions.

30 Claims, 13 Drawing Sheets

SHADOW MASK SUPPORT FRAME FOR A CATHODE RAY TUBE

BACKGROUND OF THE INVENTION

This invention relates to a shadow mask support frame for a colour cathode ray tube.

BRIEF DESCRIPTION OF THE PRIOR ART

Colour cathode ray tubes have a metallic sheet with a multitude of holes or slots in it, referred to as a "shadow mask", disposed between the electron gun and the display screen. This shadow mask is intended to obtain a very sharp image by ensuring that the impacts of the electron beams on the display screen are situated precisely on the photophores disposed on the display screen.

The shadow masks are supported by frames with a generally rectangular shape which hold them in position close to the display screen and, possibly, ensure that they are tensioned, in order to limit any deformations resulting from local heating caused by the electron beams.

According to a known technique, a shadow mask support frame has two side uprights consisting of metallic tubes or angle steels and two end uprights consisting of angle steels or tubes placed on the side uprights and assembled by welding to the contact points. Because of the construction mode and the welding technique, the tubes or angle steels must be relatively thick in order to obtain sufficient rigidity. The frames thus made up are adapted to tensioned shadow masks but have the drawback of being heavy and difficult to fabricate with good geometric precision.

According to another known technique, a frame for a shadow mask consists of angle steels produced from thin strips which are assembled by welding.

In a variant, the frame is produced by pressing a metallic sheet, generally rectangular, and having a central cutout, also rectangular. The frames thus produced have the advantage of being lightweight but have the drawback of not being very rigid and because of this not very well suited to supporting tensioned shadow masks.

In order to improve the rigidity of the lightweight frames, it has been proposed, in particular in patent specification FR-2 749 104, to fabricate such frames from two thin metallic strips pressed against each other and having vertical and horizontal stiffening ribs. These frames are both lightweight and rigid, which makes it possible to use them for tensioned shadow masks, but they have the drawback of sometimes being difficult to fabricate.

In French patent application No. 99 02129, a shadow mask support frame was proposed in which the end uprights and the side uprights of the frame are generally tubular in shape and constitute a practically continuous closed hollow body containing at least one plane closed line situated entirely inside the hollow body.

Preferably, the hollow body consists of one or more thin metallic membranes folded so as to form all or part of the hollow body and assembled for example by welding.

Such a shadow mask support frame which is lightweight, rigid and easy to fabricate is indeed adapted to the case of generally flat frames, that is to say frames on which the longitudinal axes of the uprights are substantially in the same plane, the longitudinal uprights being connected to the end uprights at the corners of the frame.

Other types of frame are known which have end uprights (or horizontal uprights) and side uprights (or vertical uprights) whose axes or horizontal directions are situated in offset parallel planes.

In such frames, the end uprights generally consist of angle steels having a first flat wall situated in a reference plane of the frame substantially parallel to the position of the shadow mask carried by the frame and a second wall perpendicular to the first wall, by means of which a compression force is exerted on the frame, during the welding of the perforated mask, so that the frame is tensioned, when the compression force on the end uprights of the frame is released.

The side uprights of the frame generally have a substantially rectilinear main part and two end parts providing the connection and junction with the end uprights.

Each of the end parts of the side uprights has a section for joining to the end upright which is generally perpendicular or orthogonal to the main branch of the corresponding side upright and which is fixed to an end upright, in an arrangement perpendicular to the upright. Generally, the joining portion at the end of the lateral uprights is placed in abutment against the external surface of the first wall of the end upright and welded in this position to the end upright.

The welding of the abutment parts of the side uprights on the end uprights is effected by a welding method such as the TIG or MIG method. Such methods require using angle steels or tubes which are very thick, because they release a large amount of energy which is liable to deform the structures and melt the angle steels or tubes, if the walls are too thin.

In addition, the side uprights of the frame are generally produced by folding a thick tube or a bar with a square or rectangular nominal section. At the time of bending, the tube or bar are greatly deformed in the bending area. Normally a deformation in the form of a "bone" or "cask" is observed.

The result is in particular poor precision with regard to the dimensions of the side uprights in the folded state and consequently poor precision with regard to the dimensions and geometry of the frame.

The end uprights, which are slightly curved, are generally fabricated by the cold or hot bending of a thick bar in the form of an L. Obtaining precise shapes and dimensions for the end uprights requires giving great care to the operations of bending the thick bar.

When the end uprights and side uprights of the frame are assembled, the welding in abutment of the end portions of the side uprights does not make it possible to obtain a high-precision assembly.

The frames obtained must therefore be planed after assembly, so that the dimensional precision necessary for the manufacture of the shadow mask frames for cathode ray tubes is obtained.

Using shadow mask frames comprising uprights with walls which are thick and therefore heavy requires also fabricating screen envelopes for the cathode ray tube which are themselves thick and therefore heavy. The cost of a cathode ray tube is determined mostly by the quantity of glass used for manufacturing the screen and the cone of the cathode ray tube. When the screen envelope is thick, the cone of the tube is itself massive. Cathode ray tubes with heavy frames are therefore extremely expensive.

When a massive frame is used, this frame, which is suspended in the front face of the screen envelope, is liable to become detached, during shocks suffered by the tube, for example during transportation, or damage to the studs attaching the frame to the envelope may occur.

In order to compensate for the overall expansion of the massive frame in the tube, it is necessary to use bimetallic strips constituting compensation elements welded to the frame uprights. Because the frame is heavy, it is necessary to use compensation strips with a thickness of around 1 to 3 mm, which are heavy and expensive to manufacture. To be able to weld the strips to the frame, generally by resistance welding, and to avoid deformation of the uprights of the frame, it is necessary to use thick tubes or profiled sections, which makes the frame even heavier.

The weight of the frame also makes it necessary to use high-power attachment springs.

A massive heavy frame has a high thermal capacity and heats up slowly when the cathode ray tube is switched on. Because of this, the time needed to obtain good colour stability for the tube may be relatively long. In service, the temperature of the frame may reach 80 to 100° C.

During several steps of manufacturing the tube, the frame and shadow mask assembly is subjected to high temperatures of around 500° C.

The expansion of the heavy massive frame might tear the shadow mask if there were no compensation system to de-tension the shadow mask.

For this purpose, it is possible either to adjust the coefficients of expansion of the shadow mask and of the frame so that the shadow mask is de-tensioned at around 500° C., or use a compensation bar which expands more than the frame, so that the frame flexes and de-tensions the shadow mask.

The second solution, in the case of a heavy massive frame, requires the use of a heavy massive compensation bar.

When a frame is designed for a tensioned mask, it is possible to make provision for connecting the side uprights to the end uprights of the frame, close to the ends of these uprights.

In this case, when a uniform pressure is exerted on the end uprights, these flex between the two side uprights, so that the deformation in the central part of the end uprights is greater than the deformation towards the ends of the uprights connected to the side uprights.

The deformation is therefore not at all homogeneous along the length of the end uprights.

When the compression force on the end uprights is released, the traction on the shadow mask varies considerably according to the length of the end upright. It may be difficult to obtain good surface evenness of the mask and an even tension.

It has been proposed, in order to obtain a more even distribution of the tensions along the end uprights of a frame for a tensioned mask, to move the points of connection of the side uprights to the end uprights, to a certain distance from the end of each of the end uprights, for example up to a quarter of the length of the end upright, with respect to the two ends of this upright.

It is thus possible to control the distribution of the stresses on the shadow mask and to obtain a distribution of the stresses making it possible to control the surface evenness of the mask and to modify the vibration modes of the mask, with the possibility of damping the vibration.

The necessity of producing shadow mask frames in a heavy massive form, in the case of frames having side uprights in a plane offset with respect to the end uprights, stems essentially from the type of welding carried out on the abutting end portions of the lateral uprights and because the compression stresses applied to the end upright producing a shearing of the welded junction zones between the lateral uprights and the end uprights, when the shadow mask is assembled, require a strong connection.

SUMMARY OF THE INVENTION

The purpose of the invention is therefore to propose a shadow mask support frame for a colour cathode ray tube, rectangular in shape overall, having two substantially rectilinear end uprights parallel to each other comprising at least one wall substantially perpendicular to a reference plane of the frame, one edge of which is intended to receive a shadow mask in an arrangement substantially parallel to the reference plane of the frame, and two lateral uprights, tubular in shape overall, each having a main part with a substantially rectilinear axis and two end parts each connected to a portion for joining to an end upright, in an arrangement orthogonal with respect to the reference plane of the frame and parallel to the substantially plane wall of the end upright, the lateral uprights having axes parallel to each other situated in a plane parallel to the reference plane of the frame, this shadow mask support frame allowing a design of the frame which is lightweight and not very massive, to very precise dimensions and geometry, whilst obtaining good properties of rigidity and mechanical strength of the frame.

For this purpose, each of the joining portions is in contact through a lateral face with an internal face of the substantially plane wall perpendicular to the reference plane of the frame, so that the end uprights of the frame are in abutment on the joining portions of the lateral uprights.

According to a preferred embodiment, the two end uprights each comprise at least a first substantially plane wall in the reference plane of the frame and a second wall constituting the plane wall substantially perpendicular to the reference plane and therefore to the first wall, having in common with the first wall an edge with a longitudinal direction of the end upright and the two lateral uprights comprising portions joining to the end uprights, in an orthogonal arrangement with respect to the main part of the lateral upright and perpendicular to the first wall of the end upright and main parts having axes parallel to each other situated in a plane parallel to the reference plane of the frame, in an arrangement offset with respect to the reference plane of the frame; in this case, each of the joining portions is fitted in an end upright through the first wall of the end upright and fixed against the internal face of the second wall perpendicular to the reference frame.

In a particular embodiment, the end parts or extensions of the lateral uprights constitute, in pairs, continuous uprights in the direction of the end uprights joining the ends of the main parts of the lateral uprights, in pairs in order to constitute a complete flat frame. Each of the continuous uprights of the flat frame parallel to an end upright comprises at least one joining portion. The end uprights in which the joining portions are fitted have faces defining a reference plane parallel to the flat frame of the lateral uprights and more or less offset in a direction orthogonal with respect to the flat frame.

Each of the continuous uprights parallel to an end upright can comprise two joining portions spaced apart from each other in the longitudinal direction of the continuous upright and connected together by a connecting part between the extensions of the lateral uprights in order to constitute the continuous upright. Each of the continuous uprights can comprise a single joining portion disposed in a middle part of the continuous upright common to the two extensions of the lateral uprights constituting the continuous upright.

BRIEF DESCRIPTION OF THE DRAWINGS

In order to give a clear understanding of the invention, a description will now be given by way of example, referring to the accompanying figures, of several embodiments of a shadow mask support frame according to the invention.

FIG. 9A is a plan view of a metallic strip for producing the lateral upright, FIG. 9B is a perspective view of the folded and welded lateral upright, FIG. 9C is a perspective view of the lateral upright heated to a heat treatment temperature, during its manufacture.

DESCRIPTION OF THE PREFERRED EMBODIMENTS

Figure 1:
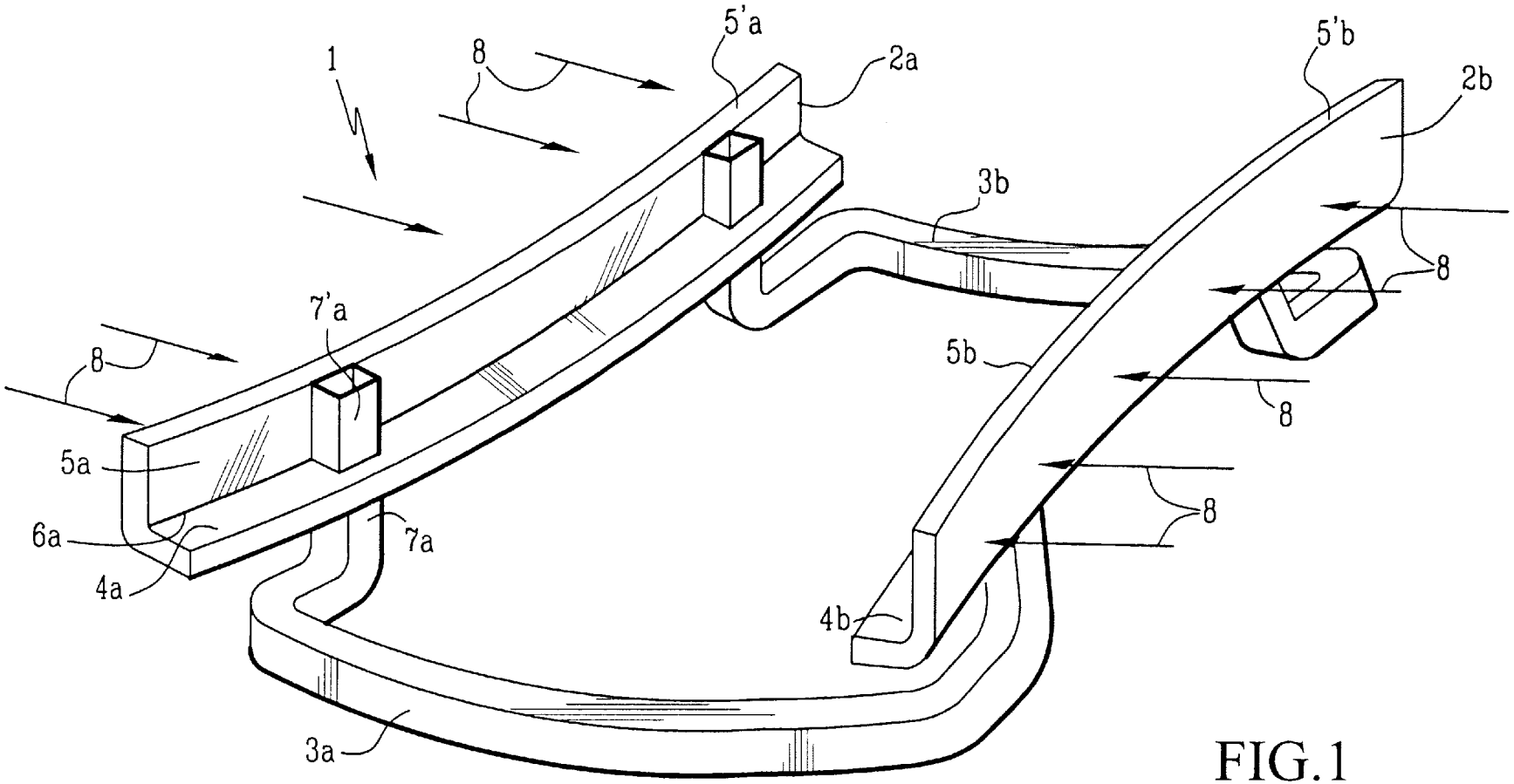
FIG. 1 is a perspective view of a shadow mask according to the invention and according to a first embodiment.

In FIG. 1, a mask support frame according to the invention can be seen, designated in general terms by the reference 1.

The mask support frame 1 comprises two end uprights 2*a* and 2*b* and two lateral uprights 3*a* and 3*b* constituting, with the end uprights 2*a* and 2*b*, a frame of rectangular shape overall.

The end uprights 2*a* and 2*b* can consist of angle steels each comprising a first wall 4*a* (or 4*b*), the first walls 4*a* and 4*b* of the end uprights 2*a* and 2*b* being in the same plane constituting the reference plane P of the frame.

The end uprights have second walls 5*a* and 5*b* respectively perpendicular to the first walls 4*a* and 4*b* and having in common with these an internal edge such as 6*a* in the longitudinal direction of the end upright. The shadow mask must be fixed along the external edges 5'*a* and 5'*b* of the end uprights 2*a* and 2*b*, in an arrangement substantially parallel to the reference plane of the frame.

The lateral uprights 3*a* and 3*b* each consist of a tubular element or a bar, for example with a square cross-section, and have a central part with a substantially rectilinear shape and two end parts joining the lateral upright with the end uprights.

The axes of the main parts of the lateral uprights are parallel to each other and situated in a plane parallel to the reference plane of the frame and offset with respect to this plane in a direction perpendicular to the reference plane of the frame.

The end parts or extensions of the lateral uprights (such as 7*a*) have two successive parts directed at 90° with respect to the axis of the main part of the lateral upright and perpendicular to each other.

The terminal portion 7'*a* of the end part 7*a* of the lateral upright 3*a* which is orthogonal to the longitudinal direction of the main part of the lateral upright 3*a* is disposed with respect to the end upright 2*a*, so that the wall Sa is in abutment, through a face directed towards the inside of the frame 1, on the lateral wall of the terminal portion 7'*a*. Where the end upright is an angle steel or a hollow beam, the terminal portion 7'*a* is fitted in the end upright, in a direction perpendicular to the longitudinal direction of the end upright 2*a*.

In addition, the end joining portion 7'*a* of the end part 7*a* of the lateral upright 3*a* is attached and fixed, for example by welding, against the internal face of the wall 5*a* of the end upright.

Each of the end parts of the lateral uprights 3*a* and 3*b* is fixed in a similar manner, by embedding and fixing plane to plane, inside an end upright, so as to form the frame 1 with a rectangular shape overall.

As depicted by the arrows 8 in FIG. 1, the compression deformation of the frame, when the shadow mask which is to be welded along the edges 5'*a* and 5'*b* is mounted, is effected by means of the second walls 5*a* and 5*b* of the end uprights 2*a* and 2*b*.

Because of this, the thrust is transmitted to the end connecting parts such as 7*a* of the lateral uprights without this thrust force producing high stresses in the connecting area between the joining portion 7'*a* at the end of the end part 7*a* of the lateral upright and the internal face of the second wall 5*a* of the end upright 2*a*.

The strength of the frame is not highly dependent on the strength of the connection between the connecting portions such as 7'*a* and the internal faces of the second walls of the corresponding end uprights.

It is therefore possible to use, for producing the uprights 3*a* and 3*b* and the end uprights 2*a* and 2*b*, tubes and angle steels with relatively thin walls. The weight and cost of the shadow mask support frame is thus reduced, whilst obtaining a frame having perfect rigidity. This is because, as indicated above, in the frames according to the prior art in which the joining portions of the end parts of the lateral edges were welded in abutment on the end uprights, the use of thick walls on the uprights of the frame was necessitated essentially by the problems related to the production and the mechanical strength of the join welded in abutment.

In the case of a fitting of the joining portion in the end upright, the need to use thick walls is no longer felt because the thrust is transmitted directly to the joining portion in plane to plane contact with the second wall of the end side, it is possible to envisage a Joining, for example by welding, riveting, adhesive bonding, clinching, snapping on or other method, which is not necessary very strong between the joining portion and the end upright.

The purpose of this connection between the joining portion and the second wall of the end upright of the frame is solely to fix the position of the joining portion such as 7'*a*, along the length of the end upright.

It is known that tubular structures or profiled sections with thin walls having good rigidity can be produced.

Such elements can be used for producing shadow mask frames according to the invention which are both lightweight and rigid.

Figure 2:
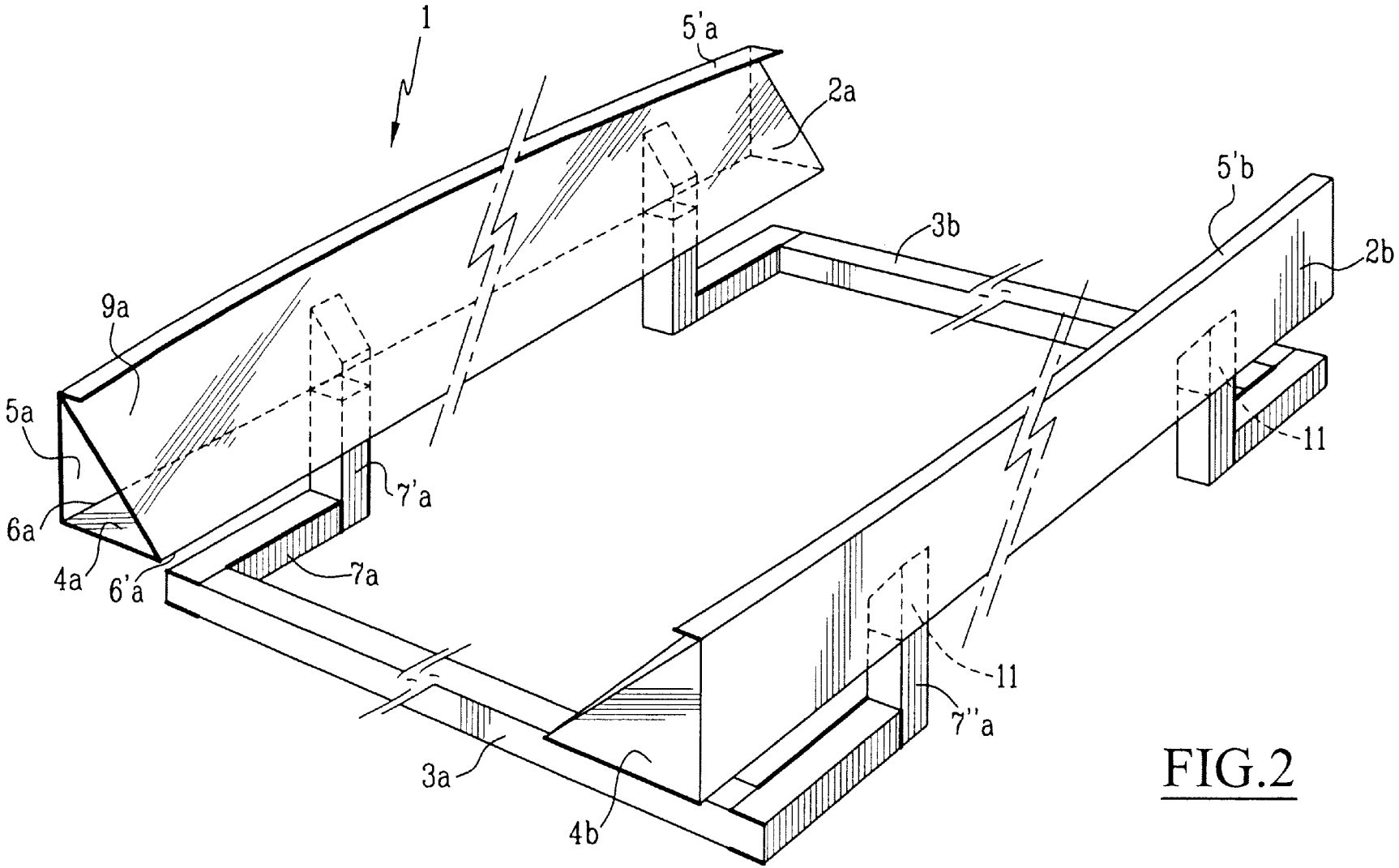
FIG. 2 is a perspective view of a shadow mask according to the invention and according to a second embodiment.

One particularly advantageous embodiment of the mask support frame according to the invention has been depicted in FIG. 2.

The corresponding elements of the frame, depicted in FIGS. 1 and 2, will be designated by the same references.

The shadow mask support frame 1 depicted in FIG. 2 is entirely produced by cropping, bending and assembling thin strips, made from a metallic material adapted to the properties required for the shadow mask support frame.

The end uprights 2*a* and 2*b* and the lateral uprights 3*a* and 3*b* of the frame 1 according to the second embodiment depicted in FIG. 2 are produced in the form of beams or tubes with thin walls with a high moment of inertia.

As in the case of the frame depicted in FIG. 1 and relating to a first embodiment, in the case of the second embodiment of the frame 1 depicted in FIG. 2, the end parts such as 7*a* of the lateral uprights 3*a* and 3*b* are fitted inside the corresponding end uprights 2*a* and 2*b* and fixed to these uprights by means of an end joining portion such as 7'*a*.

The end uprights 2*a* and 2*b* are produced in the form of substantially rectilinear beams with a triangular cross-section and the lateral uprights 3*a* and 3*b* in the form of tubes, for example with a square or rectangular cross-section.

The end uprights 2*a* and 2*b* can be obtained from a thin metallic strip with a rectangular shape overall folded along the internal edge 6*a* common to the first wall 4*a* and to the second wall 5*a* of the end upright and along a second internal edge 6'*a* at the junction of the first wall 4*a* and a third inclined wall 9*a* of the end upright 2*a* making it possible to close the cross-section of the end upright and to obtain a very stiff beam with a triangular cross-section from a thin metallic sheet having for example a thickness between 0.5 and 1.5 mm.

In addition, the external edge of the second wall of the end upright 2*a* can be pressed and folded inwards, at approximately 90°, in order to constitute the rim 5'*a* fixing the planar mass, generally curved in shape overall.

The lateral uprights 3*a* and 3*b* have a straight main part and are fixed to the end uprights 2*a* and 2*b* by means of end parts such as 7*a* comprising an end joining portion 7'*a* engaged in an opening passing through the first wall 4*a* of the corresponding end upright 2*a*, in an arrangement adjacent to the second wall 5*a* of the end upright, so that the joining portion 7'*a* is fitted in the end upright 2*a* and fixed plane to plane, through its lateral face directed towards the outside of the frame, on the internal surface of the second wall 5*a* of the end upright 2*a*.

The end uprights 2*a* and 2*b* are produced in an identical manner and each of the lateral uprights 3*a* and 3*b* has two end parts or extensions, one of which enables the lateral upright to be connected to a first end upright and the other one of which enables the lateral upright to be connected to the second end upright.

The longitudinal directions of the end uprights are parallel to each other and the first walls 4*a* and 4*b* of the end uprights constitute a reference plane of the frame substantially parallel to the fixing surface of the shadow mask consisting of the edges 5'*a* and 5'*b* of the end uprights 2*a* and 2*b*.

The axes of the straight main parts of the lateral uprights 3*a* and 3*b* which are parallel to each other are in a plane parallel to the reference plane of the frame defined by the walls 4*a* and 4*b* of the end uprights and offset with respect to the reference plane, in a perpendicular direction common to the reference plane and to the plane of the axes of the lateral edges.

The faces of the joining portions such as 7'*a* or 7"*a* attached and fixed plane to plane on the second walls of the end uprights providing the transmission by thrust of the forces exerted on the end uprights frame, when the shadow mask is mounted, are fixed in place on the second walls of the end uprights, for example by welding, riveting, brazing or adhesive bonding, the mechanical strength of the connection along the support surface such as 11 not being critical because of the abutment of the end part of the lateral upright against an internal face of the end upright.

The terminal joining portions such as 7'*a* and 7"*a* can also be fixed by snapping on to the end uprights. In this case, the end uprights can have, along the edges of the openings where the joining portions pass, attachment parts (for example folded edges of a metal sheet constituting the wall of the upright) and the joining portions can have hollows for receiving the attachment parts, when the joining portions are engaged in the openings in the end uprights. By elastic return of the attachment parts in the hollows, the fixing of the lateral uprights on the end uprights is provided.

Figure 4:
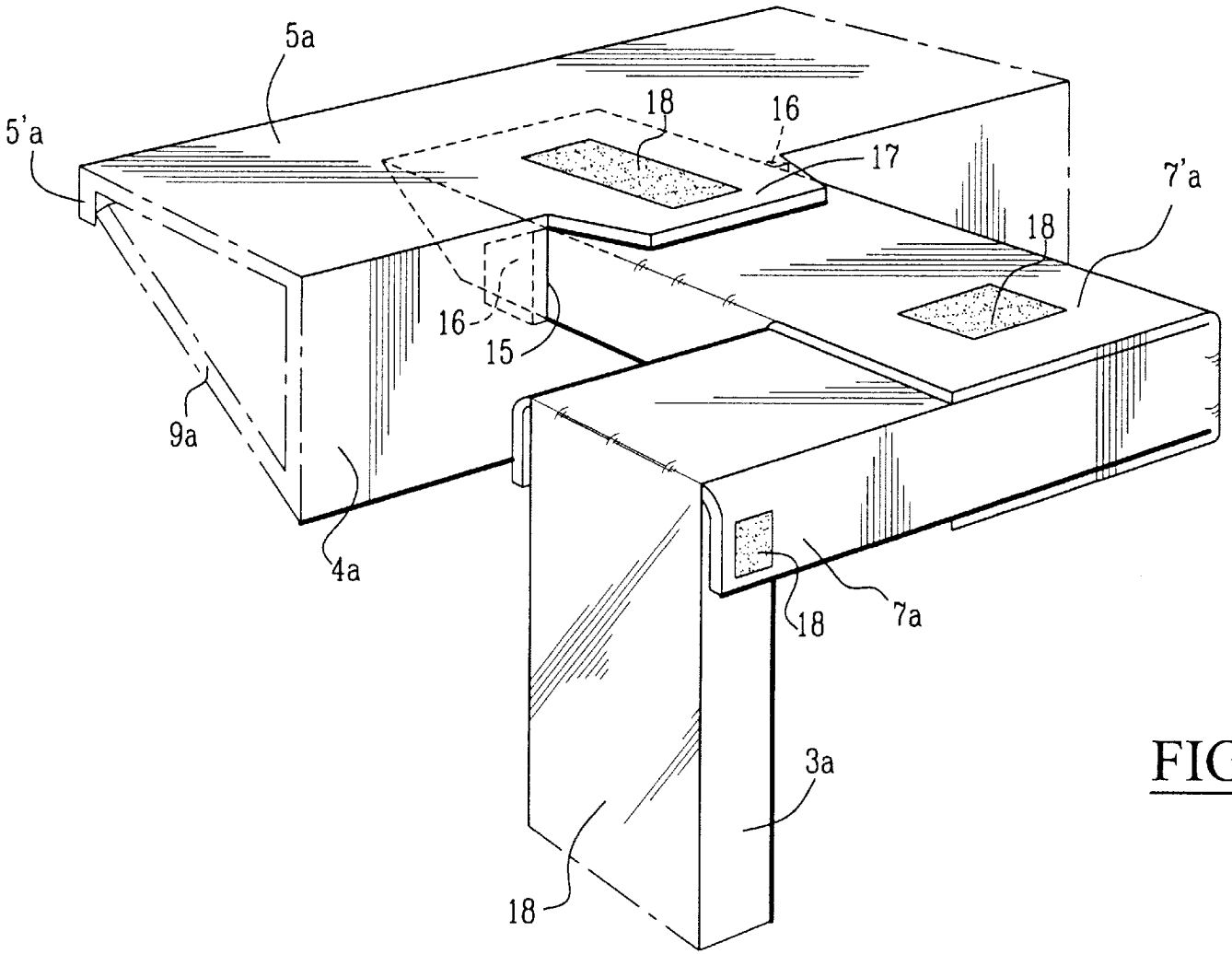
FIG. 4 is a perspective view of a joining part between an end upright and a lateral upright of a mask support frame as depicted in FIG. 2.

In the case of the embodiment depicted in FIG. 2 and in more detail in FIG. 4, the end parts of the lateral uprights such as 7*a* constitute an elbow enabling the area of fitting the joining portions 7'*a* to be offset with respect to the longitudinal end of the corresponding end upright 2*a*.

The through openings produced through the first wall 4*a* of the end uprights such as 2*a* and enabling the end parts of the lateral uprights 3*a* and 3*b* to be fitted are each offset with respect to the corresponding end of the upright 2*a* towards the central part of the upright, so that the abutment zones 11 offset towards the central part of the end upright provide a more even deformation of the end upright when compression forces are exerted at the time of fixing of the shadow mask to the fixing edges 5'*a* and 5'*b*.

Each of the joining parts of the lateral uprights such as 7*a* have a first rectilinear part perpendicular to the axial direction of the main part of the upright and a second rectilinear part constituting the joining portion 7'*a* perpendicular to the first rectilinear part and orthogonal to the axial direction of the corresponding lateral upright.

Each of the lateral uprights 3*a* and 3*b* is fixed at its ends, in the same way, in an end upright.

Figure 3:
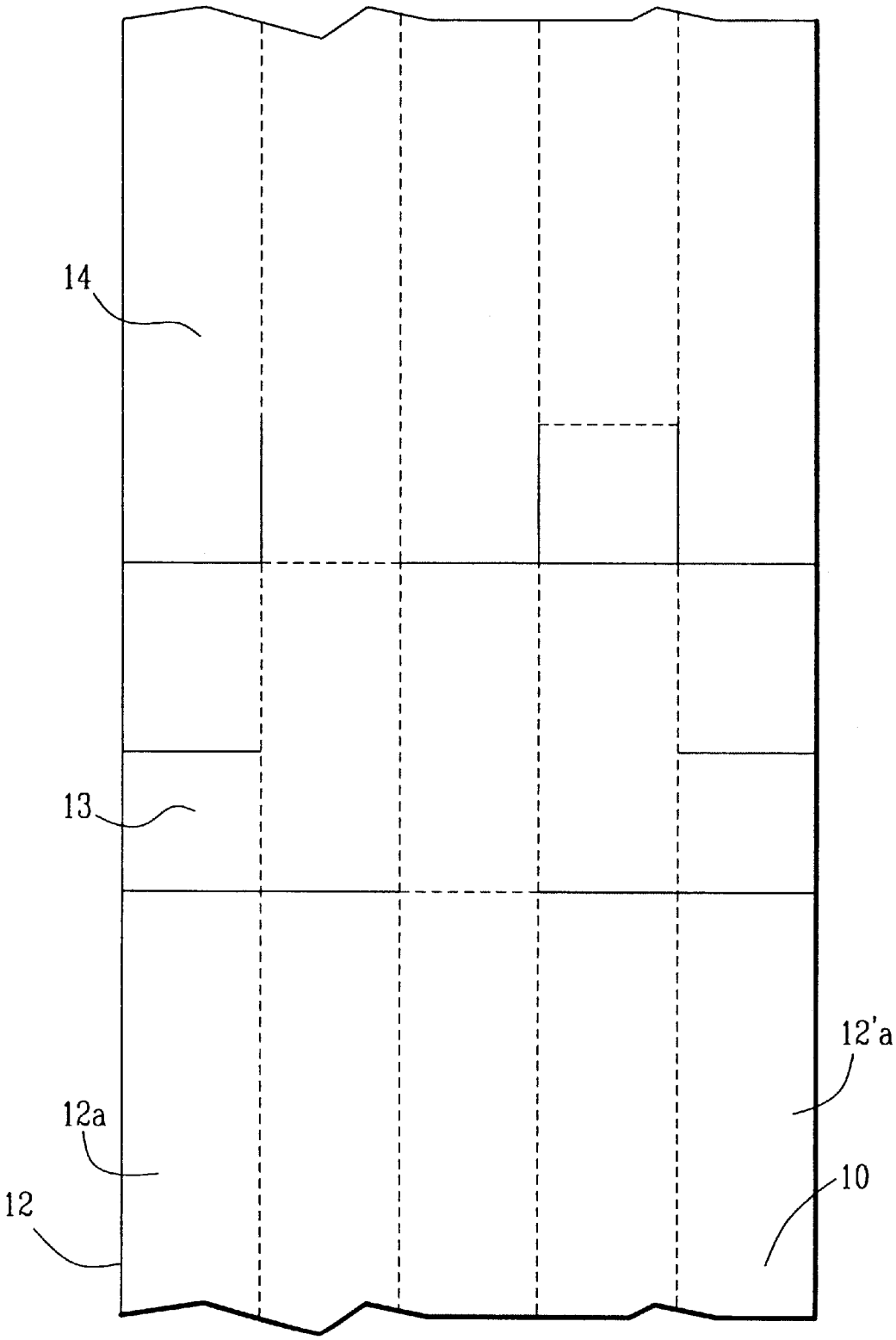
FIG. 3 is a plan view of a metallic strip used for fabricating a lateral upright of a frame according to the invention as depicted according to FIG. 2.

FIG. 3 depicts in plan view a thin metallic strip 10 intended to constitute an end connecting part as depicted in FIG. 4 of a lateral upright 3*a* as depicted in FIG. 2.

In FIG. 3, the folding lines of the thin strip have been depicted by dotted lines and the cropping lines of the thin strip by solid lines.

A first part 12 of the metallic strip having five adjacent zones delimited by folding lines constitutes the end zone of the main part of the lateral upright which has four flat walls and a flap 12*a* intended to be superimposed during folding on the zone 12'*a* in order to achieve the assembly of the main part of the upright by plane to plane welding of the zones 12*a* and 12'*a* folded on each other.

Preferably, the welding is carried out by transparency laser and the bottom wall consisting of the zone 12'*a* on which the zone 12*a* is superimposed is folded so as to have an angle slightly greater than 90° with the adjacent wall. Because of this, during welding, an abutment of the two walls 12*a*, 12'*a* on each other is achieved by exerting a pressure on the wall 12*a*. The wall 12'*a* is thus effectively pressed against the wall 12*a* by elastic return.

The zone designated in general terms by the reference 13 in FIG. 3 corresponds, in general terms, to the first rectilinear part of the end wall 7*a* of the lateral upright.

The zone 14 corresponds in general terms to the joining portion 7'*a* at the end of the lateral upright.

Figure 7:
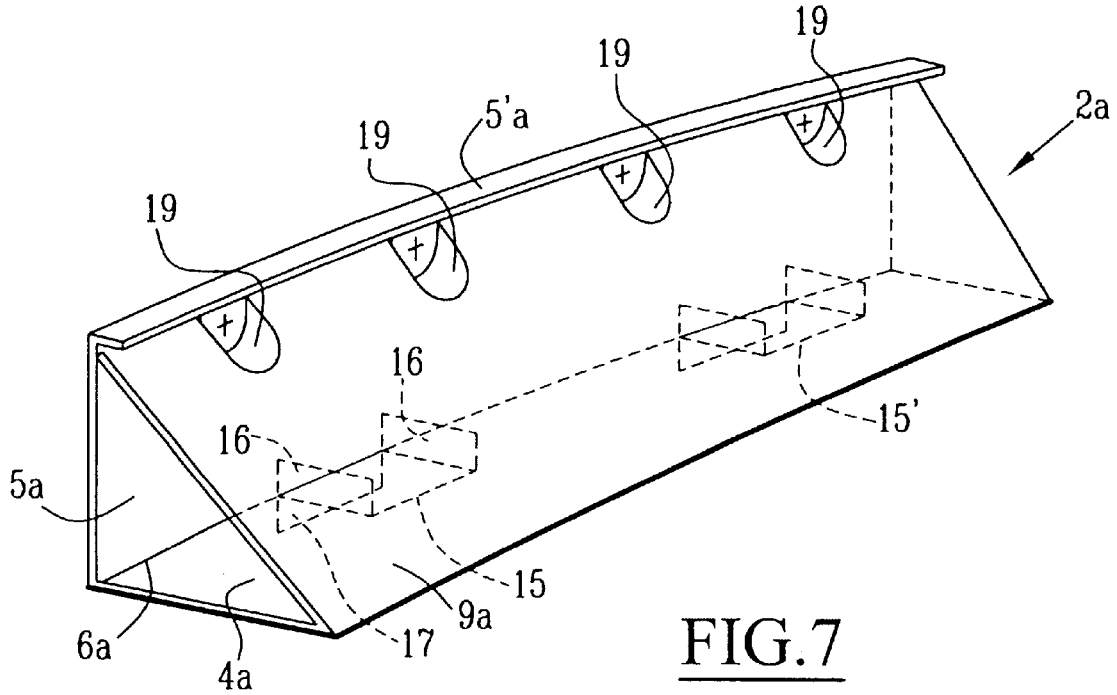
FIG. 7 is a perspective view of an end upright of the frame according to the invention and according to the second embodiment depicted in FIG. 2.

As can be seen in FIG. 7, the end upright 2*a* produced by folding a substantially rectangular strip has, in its first wall 4*a*, two openings 15 and 15' intended to receive the end joining portions of two lateral uprights embedded in the end wall 2*a*.

The openings 15 and 15' are adjacent to the internal edge 6*a* common to the first and second walls 4*a*, 5*a* of the upright 2*a* and, when the openings 15 and 15' are cut out, tongues 16 and 17 are provided for holding and fixing an embedded end part of a lateral upright on three edges of the embedding openings such as 15 and 15'.

As can be seen in FIG. 4, the assembly and fixing of the different walls of a lateral upright and the fixing of the lateral upright on the end upright, for example by means of tongues 16 and 17 and the abutment surface 11, can be carried out according to transparency laser welding zones 18.

Preferably, the fixing of the walls and the stiffening of the end uprights 2*a* in the form of beams with a triangular cross-section are effected inside cavities 19 produced by pressing of the wall 9*a* of the end upright in different places distributed along the length of the end upright, below the fixing edge 5'*a* of the shadow mask. The wall 9*a* of the end upright in the areas deformed by pressing constituting the cavities 19 is in contact with the second wall 5*a* of the end upright, so that it is possible to effect the welding of the two walls in contact with each other inside cavities 19, for example by means of a laser beam.

Figure 5:
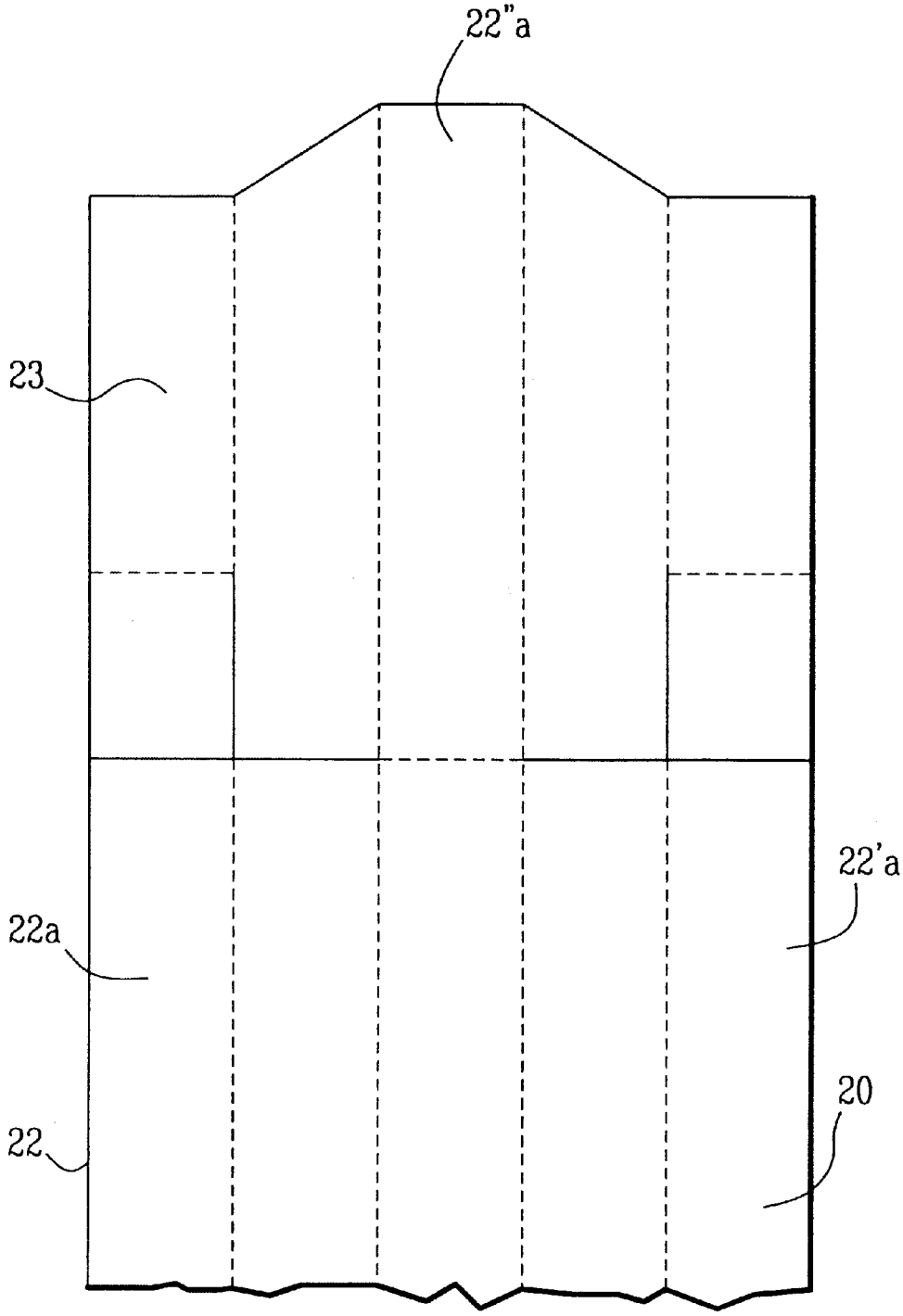
FIG. 5 is a plan view of a metallic strip for manufacturing a lateral upright of a shadow mask support frame according to a first variant of the second embodiment.
Figure 6:
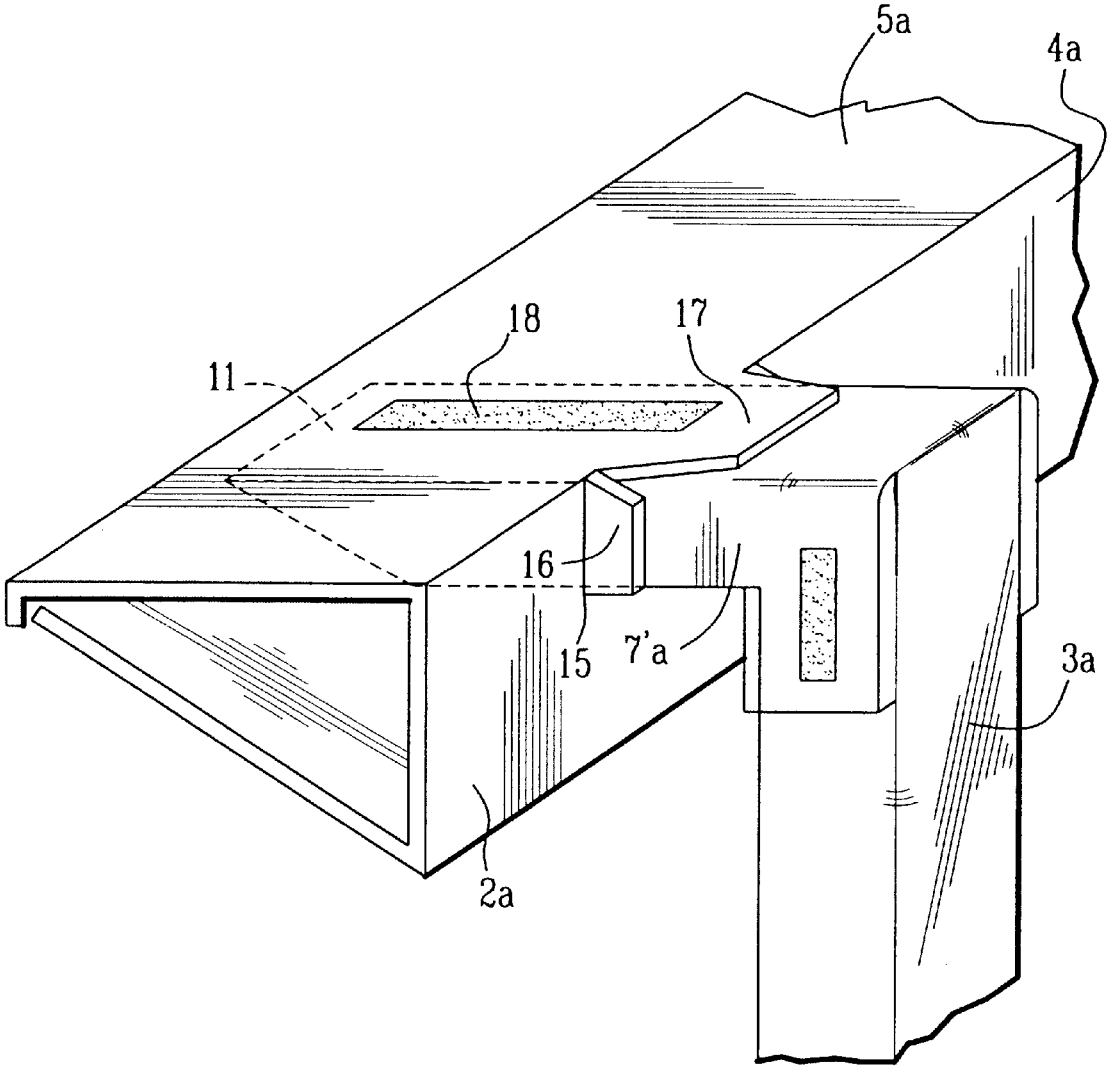
FIG. 6 is a perspective view of a joining part between an end upright and a lateral upright of a mask support frame according to the first variant embodiment.

FIGS. 5 and 6 depict a first variant of the second embodiment of an end part of a lateral upright, in its area of joining to an end upright.

FIG. 5 depicts a metallic strip 20 used for manufacturing a lateral upright of a frame according to the first variant of the second embodiment.

FIG. 5, in the same way as FIG. 3, depicts in dotted lines the folding lines of the strip 20 and in solid lines the cropping lines for obtaining the end part 7*a* of a lateral upright 3*a* as depicted in FIG. 6 in a position of assembly to an end upright 2*a* identical to the upright depicted in FIG. 7.

Unlike the lateral upright depicted in FIG. 4 and obtained from the metallic strip depicted in FIG. 3, the lateral upright depicted in FIG. 6 and obtained from the strip 20 depicted in FIG. 5 does not have any elbow for connecting the end joining portion 7'*a*, the joining portion 7'*a* being connected directly at right angles to the main part of the lateral upright 3*a*.

As can be seen in FIG. 6, the end joining portion 7'*a* of the lateral upright 3*a* is engaged in an opening 15 in the first wall 4*a* of the end upright 2*a*, in an area of the end upright situated at a certain distance from its longitudinal end.

As can be seen in FIG. 5, the strip 20 has a part 22, substantially identical to the part 12 of the strip 10 depicted in FIG. 3, and which has five successive adjacent zones separated by folding lines making possible to obtain the straight main part of the upright 3*a* having the form of a tube with a square cross-section.

The end zone 22*a* constitutes an overlap wall or flap intended to come into abutment on the opposite zone 22'*a* constituting a wall of the main part of the upright 3*a* on which the flap 22*a* can be welded by transparency laser beam.

The zone 23 of the strip 20 constitutes the joining portion 7'*a* of the upright 3*a* and has two flaps which can be welded by laser beam against two lateral faces of the straight main part of the lateral upright 3*a*.

The joining portion 7'*a* of the lateral upright 3*a* is embedded in the end upright, so that one of its faces corresponding to the central area 22"*a* of the strip 20 comes into plane to plane contact with the internal surface of the second wall 5*a* of the end upright 2*a*, to which it is fixed in position, for example by laser welding or by any other fixing method, such as brazing, riveting or adhesive bonding.

The walls in plane to plane contact of the lateral upright 3*a* and of the end upright 2*a* constitute the abutment zone 11 by means of which thrust forces exerted on the end upright 2*a* can be transmitted to the lateral upright 3*a*.

The joining portion 7'*a* of the lateral upright 3*a* engaged in the opening 15 can be held and fixed in position by means of the tongues 16 and 17 and the contact surface along the abutment zone 11 of the end upright 2*a*.

Figure 8:
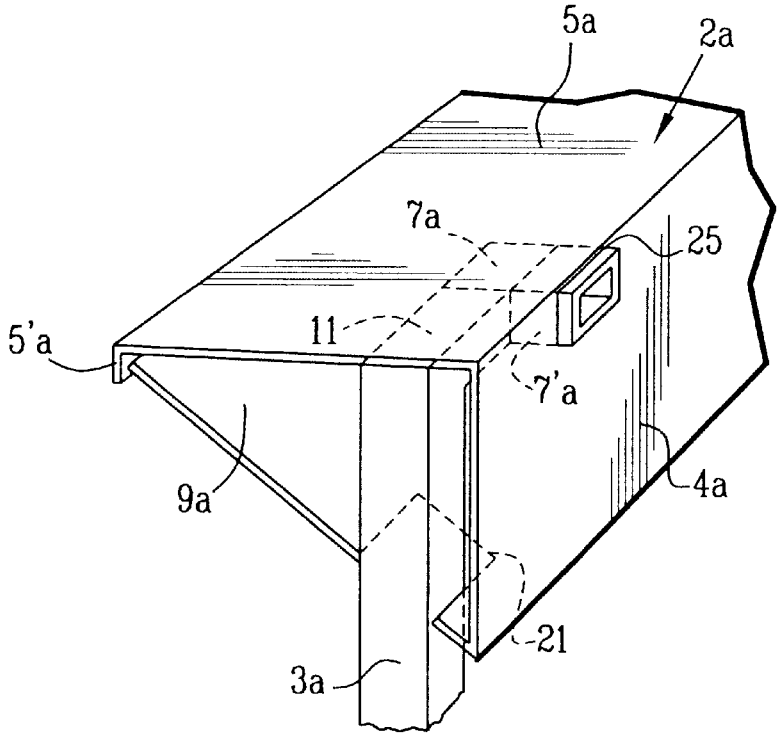
FIG. 8 is a perspective view of a second variant embodiment of the joining part between a lateral upright and an end upright of a mask support frame according to the invention and according to the second embodiment.

FIG. 8 depicts a second variant of the end part of a lateral upright 3*a* providing its junction with the end upright 2*a*.

The end upright 2*a* has, at its longitudinal ends, bevel shoulders with a substantially square shape, such as the bevel shoulder 21 depicted in FIG. 8, intended to provide passage of the end of a straight main part of a lateral upright 3*a* which can have the form of a tube with a square cross-section and which has an end connection zone 7*a* with the shape of a right angle elbow whose two successive parts have axes disposed in a plane perpendicular to the axis of the straight main part of the lateral upright 3*a*. The opening 21 passes through the inclined wall 9*a* of the end upright 2*a* which has in addition an opening 25 passing through the first wall 4*a* of the end upright 2*a*, in an area situated at a certain distance from the longitudinal end of the end upright 2*a* placed in an arrangement adjacent with respect to the second wall 5*a* of the end upright, in which an end part of the joining portion 7'*a* of the lateral upright 3*a* is embedded.

When the end part 7*a* of the lateral upright 3*a* is engaged inside the end upright 2*a* in the assembly position, as depicted in FIG. 8, one of the lateral surfaces of the end part 7*a* comprising the end portion 7'*a* is in plane to plane contact with the second wall Sa of the end upright 2*a*, on which it is fixed, for example by welding, in order to constitute the abutment zone 11.

It should be noted that, in the case of all the embodiments, there remains, between the first walls of the end uprights and the lateral uprights of the frame, in a direction perpendicular to the reference plane, a clearance which may be relatively large or, on the other hand, small, so that there exists a certain range of movement between the end uprights and the lateral uprights allowing the deformation of the frame, for example when the shadow mask is mounted, or during a phase of heat treatment or use of the frame resulting in preferential expansions.

Figure 9C:
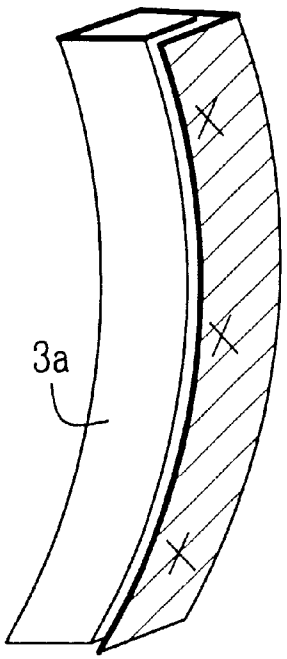
FIGS. 9A, 9B and 9C are views showing the embodiment of a lateral upright of a frame according to the invention making it possible to relax the stresses in the shadow mask.
Figure 9B:
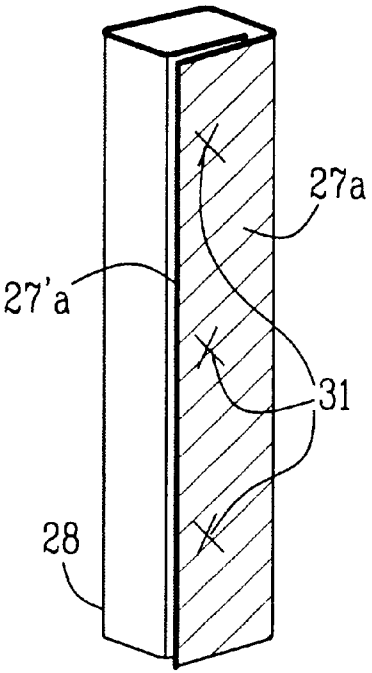
Figure 9A:
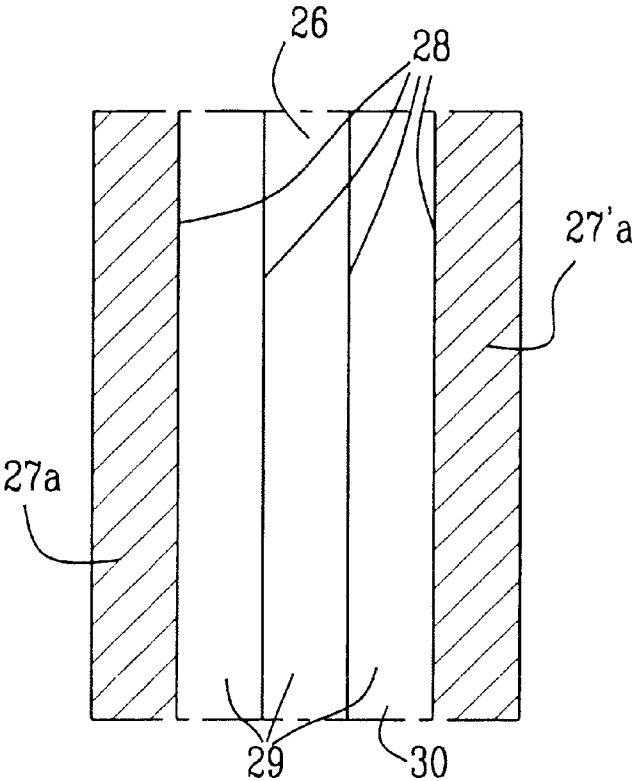

As can be seen in FIGS. 9A, 9B and 9C, it is possible to compensate for the deformations of the structure of the frame, for example during heat treatment during the manufacture of the frame (at a temperature which can be around 500° C.) without using thick and expensive compensation bars.

FIG. 9A depicts a portion of a metallic strip 30 used for producing a lateral upright of a shadow mask support frame according to the invention by a technique of cropping, folding and welding, as described above with regard to FIGS. 3 and 5.

Unlike the strips 10 and 20 used in the frame of the embodiments described above, the strip 30 is not produced in a homogeneous manner from a metallic strip in a single material but has a central part 26 made from an alloy with a low coefficient of expansion and two lateral parts 27*a* and 27'*a* made from an alloy with a high coefficient of expansion, or the reverse, according to the effect sought.

Longitudinal folding lines 28 separate the central area 26 of the strip from the lateral areas 27*a* and 27'*a* and the central part 26 into three central areas 29.

By folding the strip, as depicted in FIG. 9B, an upright is produced with a parallelepipedal shape with a square or rectangular cross-section, one of the lateral edges of which is formed by the two lateral areas 27*a* and 27'*a* consisting of an alloy with a high coefficient of expansion.

The two walls 27*a* and 27'*a* are welded to each other, for example by welding points 31 produced for example by a laser beam.

As depicted in FIG. 9C, the lateral upright 3*a* thus obtained adopts an arched shape, when it is heated, for example at a treatment temperature of 500° C., during the manufacture of the shadow mask support frame.

It is thus possible to obtain, by virtue of the curving of the tubular lateral uprights, at high temperature, a relaxation of the stresses on the shadow mask fixed to the frame. However, the tubular lateral uprights of the frame keep good elastic properties, when working at the internal operating temperature of the cathode ray tube, that is to say a temperature of 80 to 120° C.

In order to obtain the strip 30 as depicted in FIG. 9A, it is possible to perform the edge to edge welding of a first strip 26 made from an alloy with a low coefficient of expansion and two lateral strips in an alloy with a high coefficient of expansion.

For example, in the case of a frame produced from a nickel alloy, it is possible to use a first alloy whose high coefficient of expansion is around $12.10^{-6}/°$ K and an alloy with a low coefficient of expansion, for example around $1.10^{-6}/°$ K.

The thickness of the central strip and of the lateral strips is also chosen so as to obtain the effect of deformation of the support frame.

In the case of a frame for a steel shadow mask, it is possible to use a first steel with a coefficient of $12.10^{-6}/°$ K and a second alloy with a coefficient of expansion of $20.10^{-6}/°$ K.

To produce a bimetallic strip effect in order to ensure the de-tensioning of the shadow mask during the treatment of the frame, use is normally made of alloy strips with a high coefficient of thermal expansion, with great thickness, which are fixed against the external surfaces of the tubular lateral uprights. It is preferable to produce frames according to the invention by attaching and fixing, for example by plane to plane welding, thin strips to certain parts of the metallic strip intended to constitute faces of walls of the lateral uprights directed towards the inside of the uprights, after folding the metallic strip. The thin alloy strips have a coefficient of thermal expansion different from the coefficient of thermal expansion of the alloy of the metallic strip constituting the uprights of the frame, so that bimetallic strips are formed on the walls of the lateral uprights of the frame.

Figure 10A:
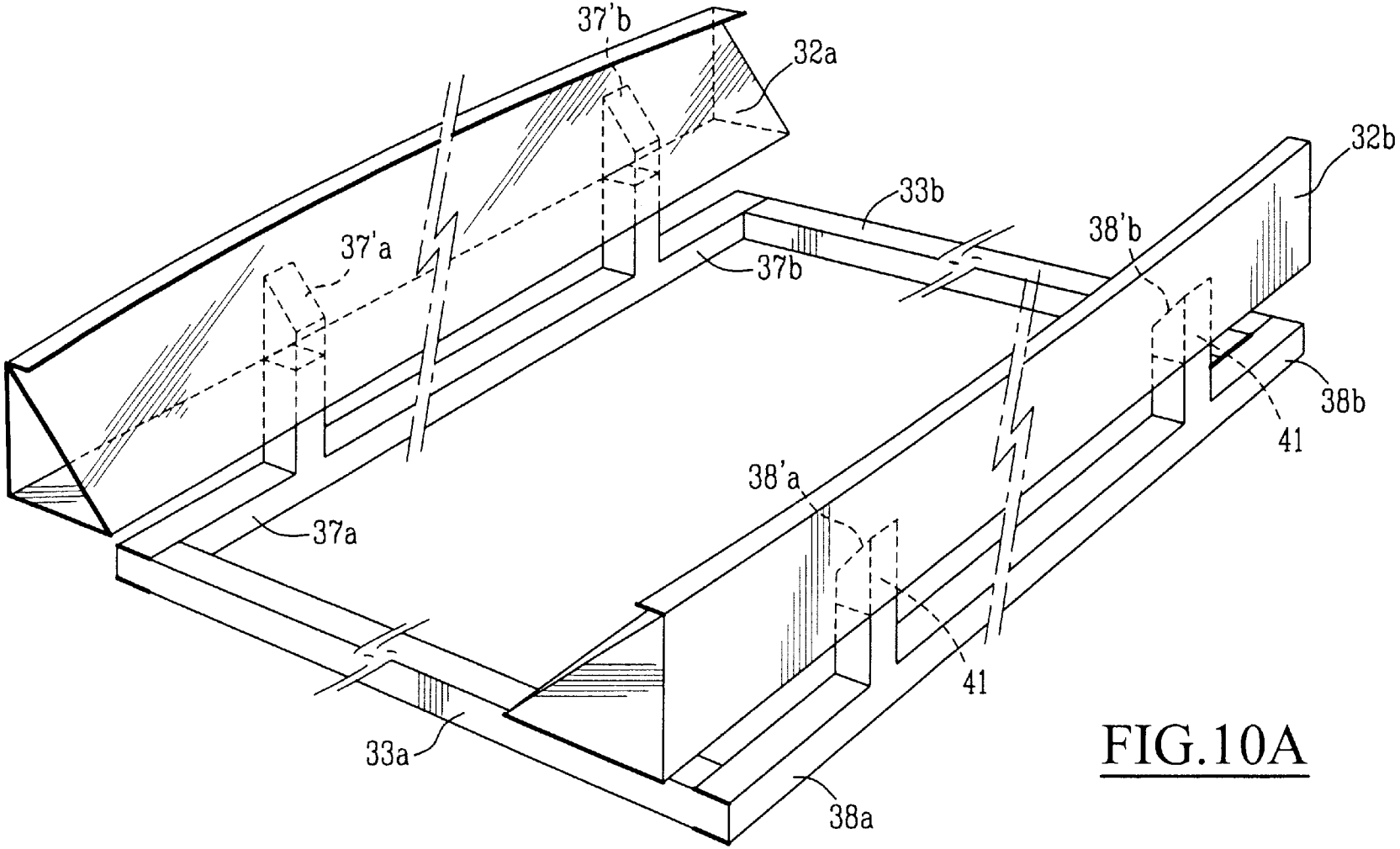
FIGS. 10A and 10B are perspective views of a frame according to the second embodiment and respectively according to a third and fourth variant.
Figure 10B:
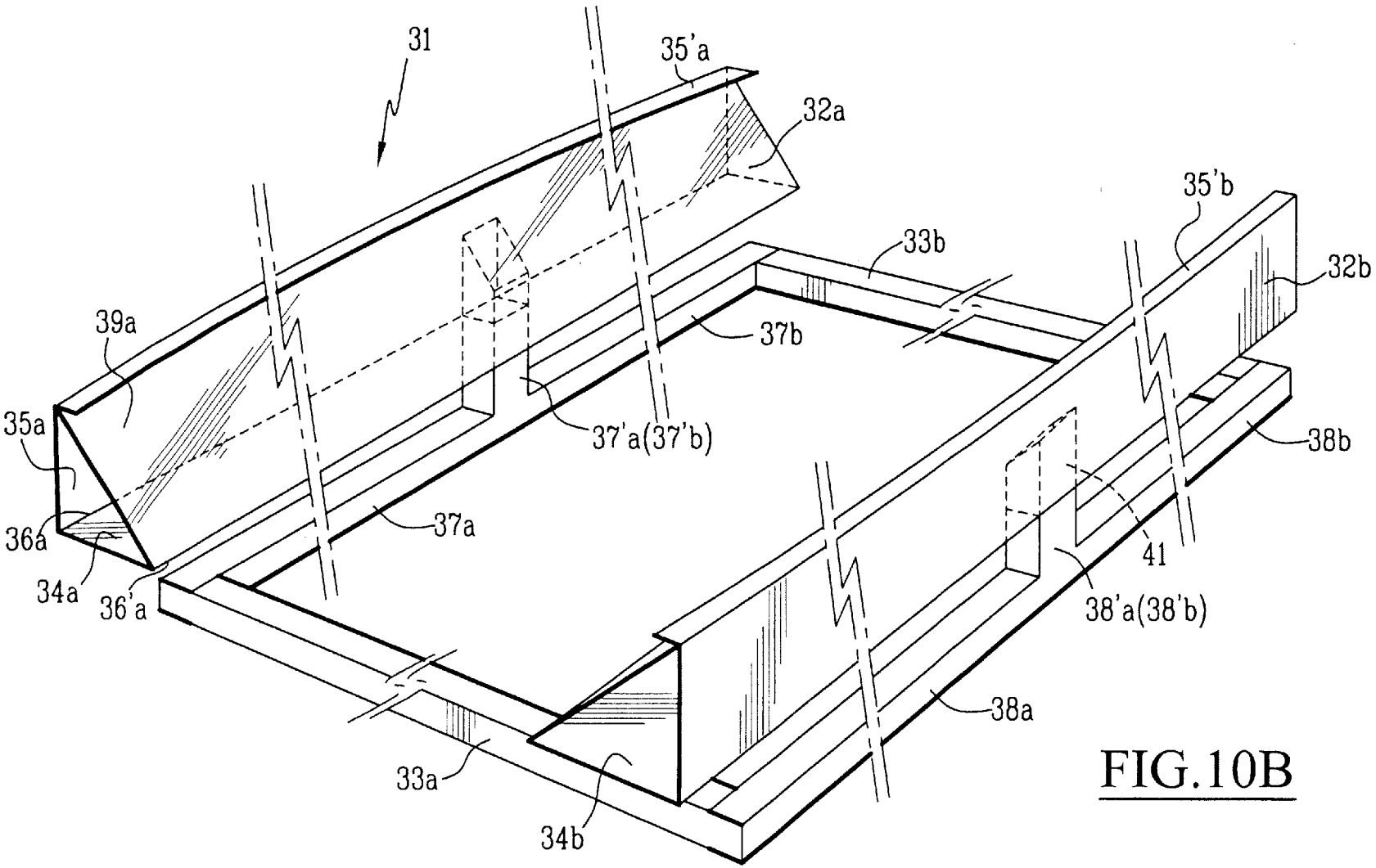

FIGS. 10A and 10B depict a shadow mask support frame according to the invention and respectively according to third and fourth variants of the second embodiment.

The frames according to the variants depicted in FIGS. 10A and 10B are produced in a similar manner to the frame according to the first variant embodiment (FIG. 2), by cropping, folding and assembling thin metallic strips. These frames have end uprights 32*a* and 32*b* which can be produced in the form of beams or tubes with a triangular cross-section.

The lateral uprights 33*a* and 33*b* can consist of beams or tubes with a square or rectangular cross-section.

In the case of the first variant embodiment depicted in FIG. 2, each of the ends of the lateral uprights carries, by means of an end part 7*a* of the upright, a joining portion 7'*a* orthogonal to the reference plane of the frame.

In the case of the variants depicted in FIG. 10A, the end parts 37*a*, 37*b* and 38*a*, 38*b* of the two lateral uprights 33*a* and 33*b* constitute in pairs continuous uprights of a flat frame each joining two ends of the lateral uprights in a direction parallel to the end uprights 32*a* and 32*b*. Each of the end parts 37*a*, 37*b*, 38*a* and 38*b* constituting the continuous uprights of the flat frame having the direction of the end uprights is integral with a respective joining portion 37'*a*, 37'*b*, 38'*a*, 38'*b* orthogonal to the reference plane of the frame defined by the walls 34*a* and 34*b* of the end uprights.

Between the two joining portions integral with two extensions such as 37*a* and 37*b* or 38*a* and 38*b* parallel to the same end upright and placed in alignment with each other there is provided a connection part constituting the central part of the continuous upright of the flat frame.

This arrangement has the advantage of making it possible to better control the rectangularity of the frame.

The frame depicted in FIG. 10A has on each end part 37*a*, 37*b*, 38*a*, 38*b* lateral uprights, a respective joining portion 37'*a*, 37'*b*, 38'*a*, 38'*b*, the joining portions situated on the same continuous upright of the flat frame being disposed on each side of the axis of symmetry of the frame parallel to the lateral uprights 33*a* and 33*b*.

The distance between the joining portions 37'*a* and 37'*b* or 38'*a* and 38'*b* and therefore the length of the connecting part of the continuous upright can be chosen, as in the case of the embodiment depicted in FIG. 2, so as to optimise the mechanical behavior of the end uprights 32*a* and 32*b*. In particular, this distance can be reduced to zero, and in this case the two joining portions 37'*a* and 37'*b* or 38'*a* and 38'*b* are merged along the portions 37'*a* and 38'*a* as depicted in FIG. 10B relating to this last embodiment.

The frame depicted in FIG. 10B has, on each continuous upright 37*a* and 37*b* or 38*a* and 38*b* of the flat frame, only one joining portion 37'*a* or 38'*a* in a middle part of the continuous upright common to the two extensions of the lateral uprights constituting the continuous upright.

In either case, the joining portions are produced and fitted in the end uprights and mounted in the same way. Because of this, hereinafter, only the fourth variant of the second embodiment corresponding to FIG. 10B will be described in detail.

In this variant, the joining portions 37'*a* and 38'*a* are fitted in the end uprights, each through an opening passing through the wall 34*a* or 34*b* of the corresponding upright parallel to the reference plane of the frame and are in abutment through an external abutment surface 41 on the internal face of the corresponding wall 35*a* or 35*b* perpendicular to the reference plane of the frame. The joining portions 37'*a* and 38'*a* in plane to plane abutment on the second walls 35*a* and 35*b* of the end uprights can be fixed by welding against the end uprights. The reference plane defined by the first walls 34*a* and 34*b* of the end uprights can be more or less distant from the flat frame consisting of the lateral uprights. For example, the first walls 34*a* and 34*b* of the end uprights can be superimposed on the top faces of the lateral uprights or placed at a certain distance above the lateral uprights.

Figure 11:
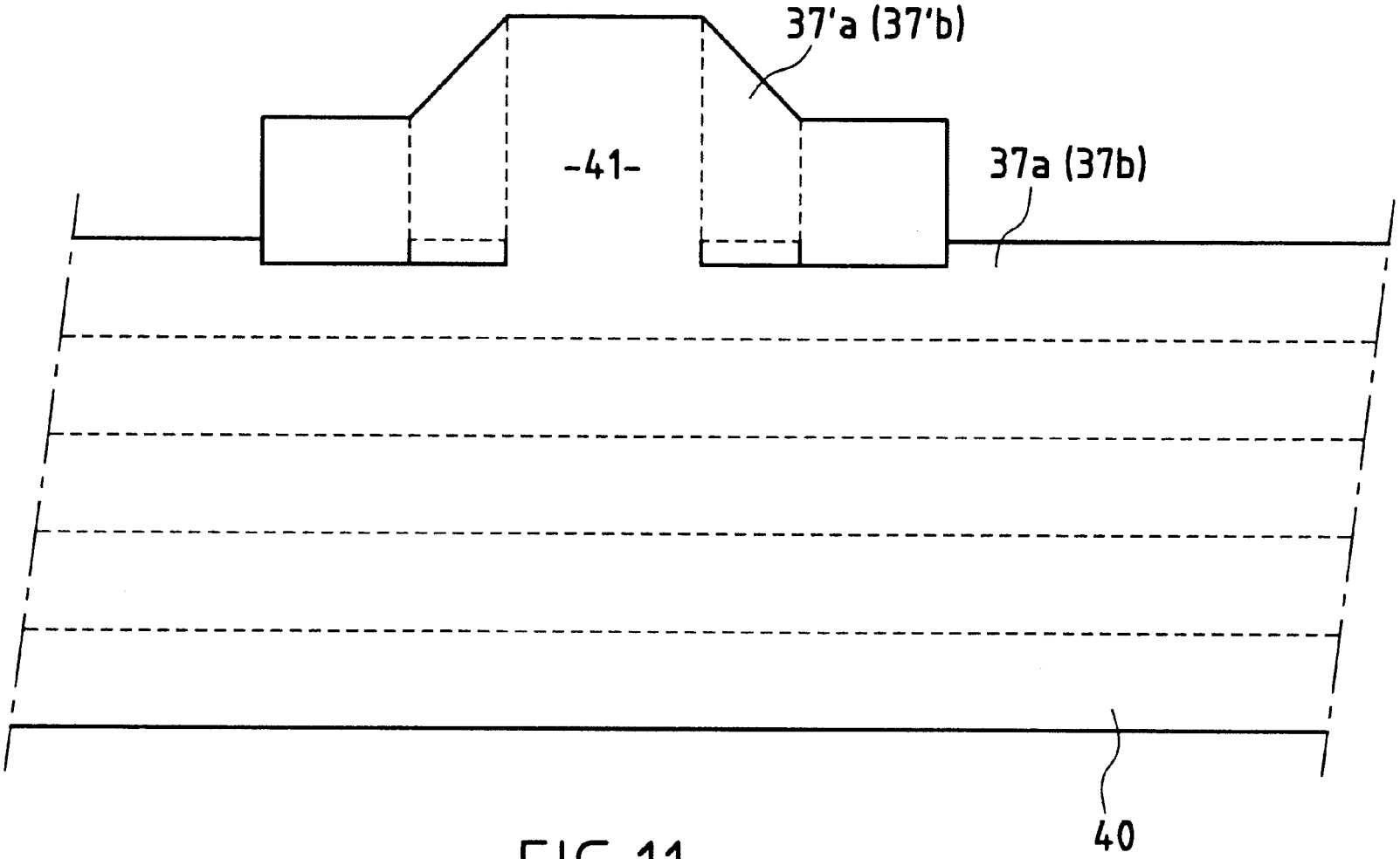
FIG. 11 is a plan view of a strip cut out for producing an end part of the lateral uprights of the frame depicted in FIG. 10A or FIG. 10B, FIGS. 12A and 12B are plan views of cutouts of the strip depicted in FIG. 11, for producing an opening according to a first and according to a second variant, in a lateral upright.

As depicted in FIG. 11, the lateral uprights can be obtained by cropping, folding and welding a metallic strip 40. The folding lines of the thin metallic strip 40 have been depicted by dotted lines and the cropping lines by solid lines. FIG. 11 depicts only part of a metallic strip 40 for the production of a continuous upright 37*a*–37*b* or 38*a*–38*b* of the flat frame consisting of two lateral upright extensions but it is clear that the two lateral uprights 33*a* and 33*b* and their extensions 37*a*–38*a* and 37*b*–38*b* can be obtained from a single metallic strip. It is also possible to produce the lateral uprights and their extensions from several metallic strips, for example four metallic strips, the lateral uprights having the form of tubes with a square cross-section being obtained from rectangular strips and the extensions from strips cut out as depicted in FIG. 11. The whole of the flat frame consisting of the lateral edges and their extensions is obtained either by folding and welding a single thin metallic strip, or by folding and welding several strips in the form of tubes which are then assembled at right angles at their ends by means of walls or miters. The welding and possibly the assembly of the parts of the flat frame can be carried out, by a transparency laser beam.

The metallic strip 40 (for producing two aligned extensions 37*a* and 37*b* of the lateral edges in a single piece) has a rectangular main part in which there are provided four folding lines in order to constitute four faces of a tube with a square cross-section and an assembly flap and a projecting part on an edge of the thin strip cut out along a contour making it possible to obtain by folding a joining portion 37'*a* (or 38'*a*) closed by a flap.

In the case of a frame according to the embodiment depicted in FIG. 10A, the metallic strip for producing a continuous upright such as 37*a*–37*b* or 38*a*–38*b* of the flat frame has two projecting parts similar to the projecting part of the strip 40 depicted in FIG. 11. These projecting parts can be at any distance from each other along the length of the metallic strip and are connected by a part of the metallic strip intended to constitute the connection part of the continuous upright.

The projecting part of the metallic strip 40 comprises a central part 41 in a single piece with the middle area, along its length, of the continuous upright consisting of the aligned extensions 37*a* and 37*b* or 38*a* and 38*b*, and two symmetrical lateral parts separated from the main part of the strip 40 by a cutout intended to constitute, by folding, faces of the joining portion 37'*a* or 38'*a* and an assembly flap.

The lateral edges are produced from a strip or a part of a rectangular strip similar to the main part of the strip 40.

The end uprights, which can also be obtained by cropping, folding and welding metallic strips, have openings in the middle part of their faces 34*a* and 34*b* defining the reference plane of the frame to allow the passage of the joining portions 37'*a* and 38'*a*. These openings produced by cropping the metallic sheet of the end uprights can have tongues for fixing the joining portions along their edges, which are reserved when the openings are cut out.

Figure 12A:
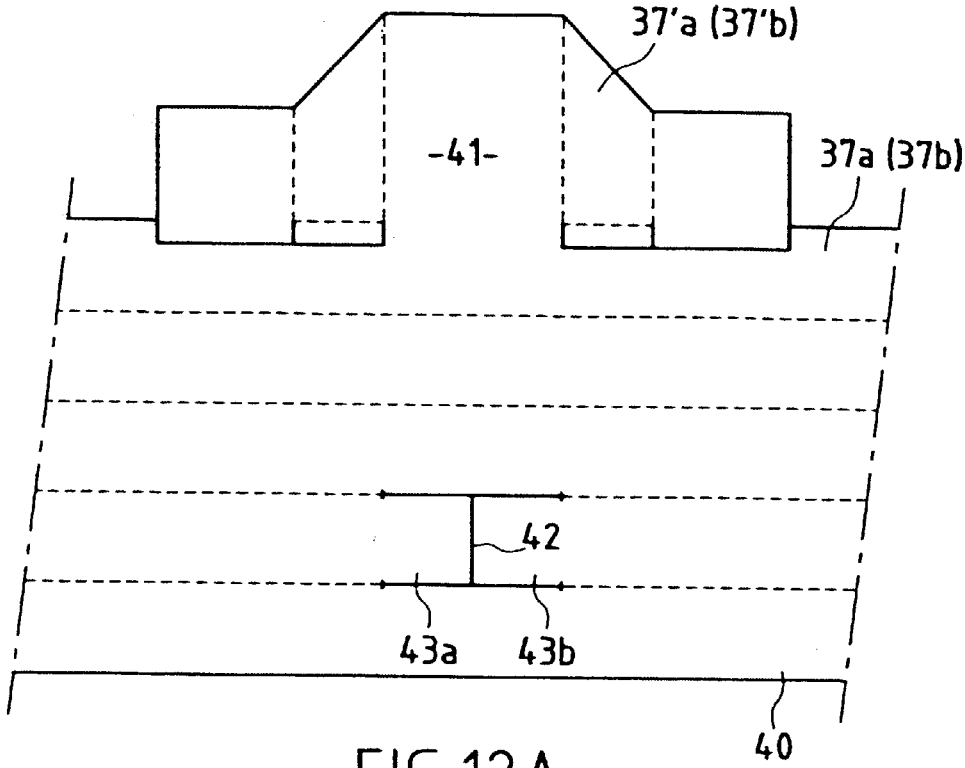
Figure 12B:
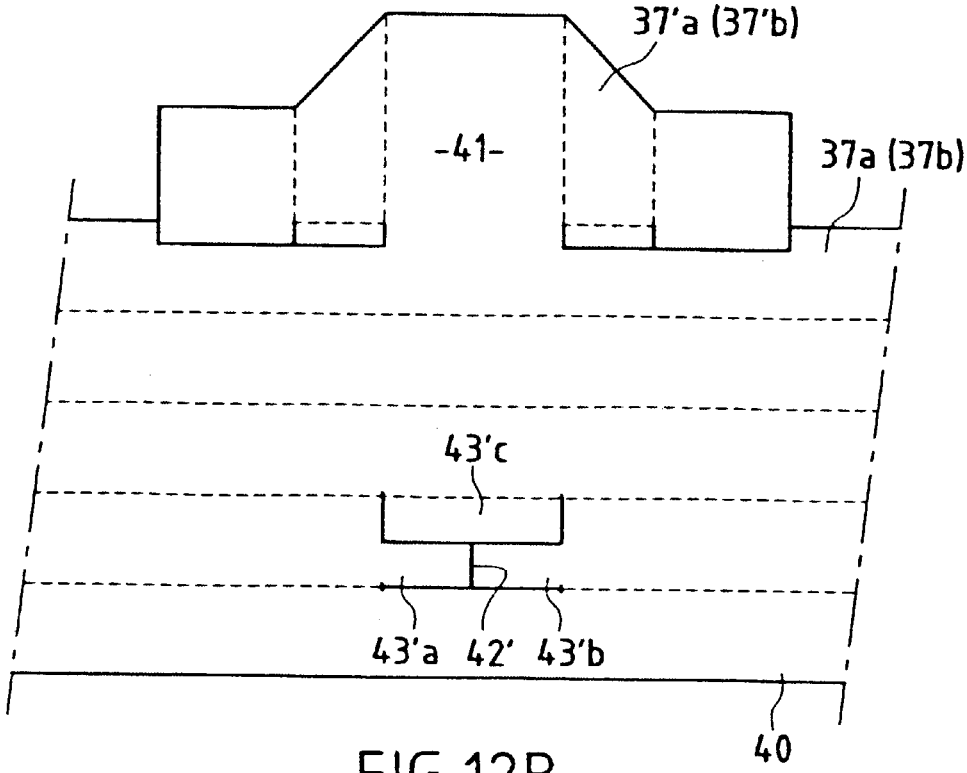

As depicted in FIGS. 12A and 12B, the face of the continuous upright which consists of two aligned extensions such as 37*a* and 37*b* of a lateral edge, intended to be folded down along the edge of the strip 40 comprising the joining portion may have, in its middle part coming inside the joining portion in the folded state, a cutout 42 or 42' enabling the internal part of the joining portion to be put in communication with the internal part of the lateral upright.

The cutout 42 (FIG. 12A) is produced so as to form two fixing tongues 43*a* and 43*b* for the joining portion, along the entire width of the cropped face. The cutout 42' (FIG. 12B) is produced so as to form three fixing tongues 43'*a*, 43'*b* and 43'*c* along only part of the width of the cropped face which are folded along respective transverse and longitudinal folding lines.

In addition, the embedding of the joining portions in the end uprights and particularly the abutment of these portions on the walls 35*a* and 35*b* by means of the external abutment surfaces 41 makes it possible to easily produce a high-strength connection between the lateral uprights and the end uprights.

When the shadow mask is mounted on the frame or when the assembly consisting of frame plus shadow mask is integrated, this assembly is subjected to a thermal cycling which results in differential expansions which can cause unacceptable excessive tension in the mask.

Figure 13:
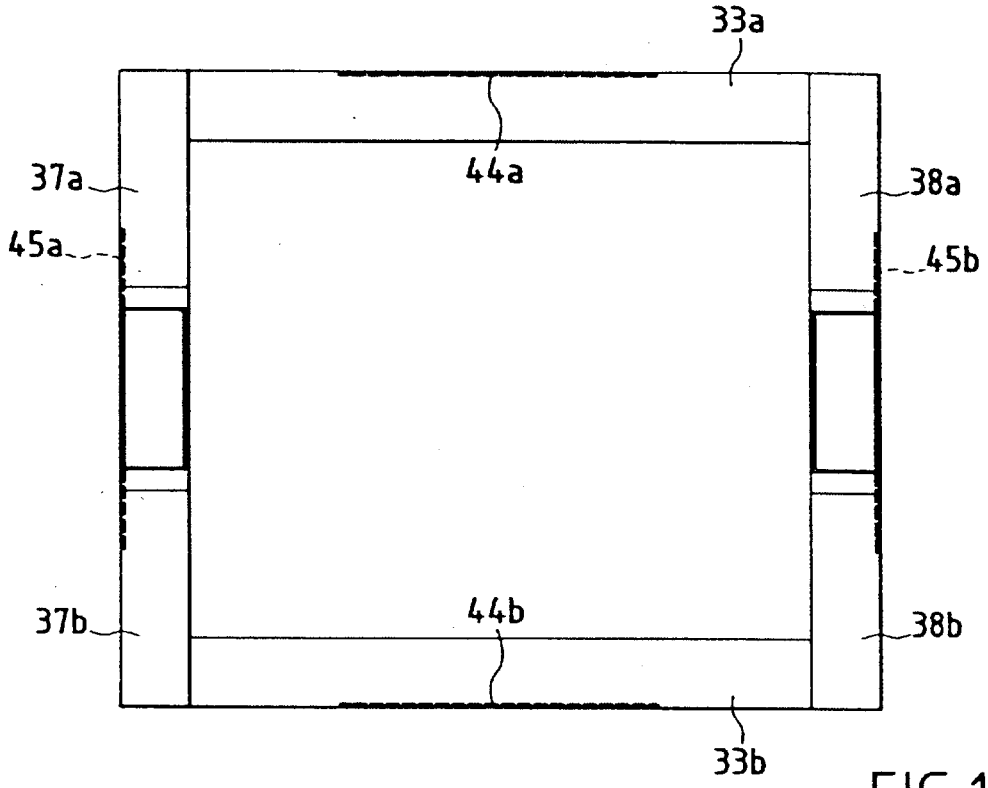
FIG. 13 is a simplified plan view of a flat frame formed by the lateral uprights of a frame as depicted in FIG. 10A or FIG. 10B.
Figure 14:
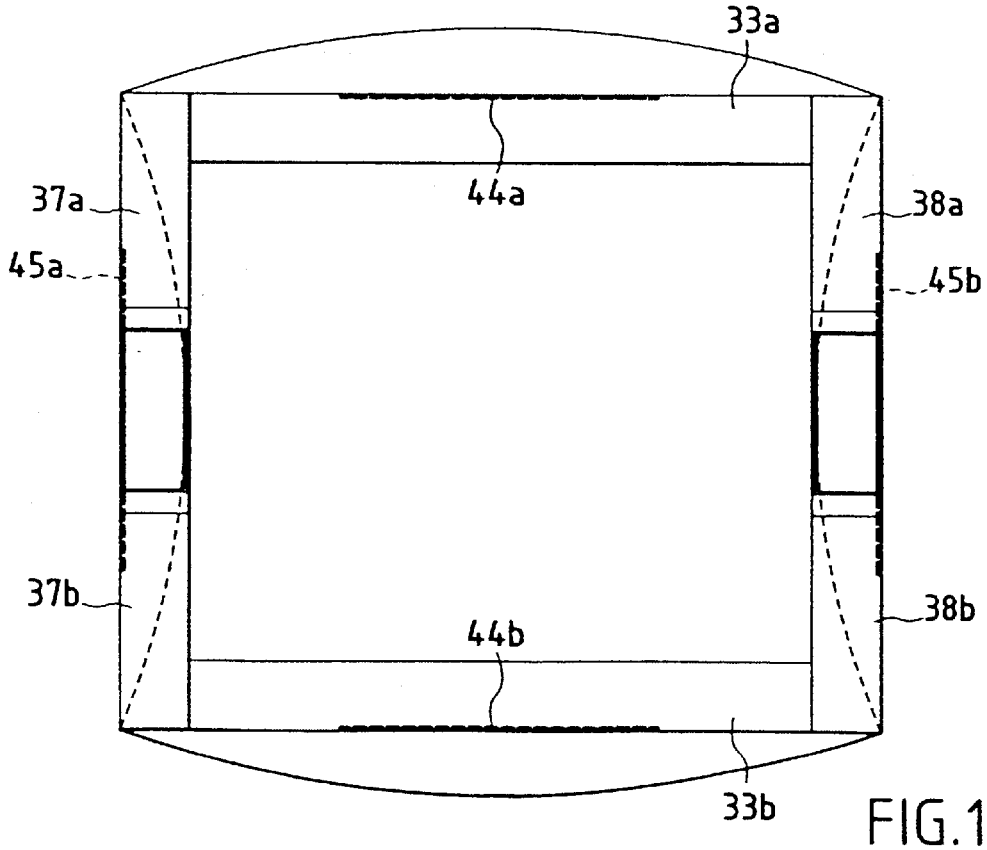
FIG. 14 shows the flat frame of FIG. 13 in a deformed state.

To avoid or limit this excessive tension, it is possible, as depicted in FIGS. 13 and 14, to produce the lateral uprights 33*a* and 33*b* of the frame and their extensions 37*a*, 37*b* and 38*a*, 38*b* parallel to the end uprights so that these lateral uprights and possibly their extensions behave like bimetallic strips which deform so as to reduce the distance between the middle parts of the extensions 37*a*–37*b* and 38*a*–38*b* of the lateral uprights when the temperature increases.

To obtain this result, the lateral uprights must deform by curving in the plane of the frame, so that the concavities of the deformed lateral uprights are oriented towards the inside of the frame. This deformation of the lateral uprights causes a flexion of their extensions, which move closer to each other, the middle parts of these extensions, as depicted by the curved lines in solid lines and dotted lines in FIG. 14, showing respectively an external face of the lateral uprights and their extensions in the deformed state.

The extensions 37*a*–37*b* and 38*a*–38*b* of the lateral uprights 33*a* and 33*b* can also behave as bimetallic strips which, when heating up, curve in the plane of the frame so that the concavities of the extensions 37*a*–37*b* and 38*a*–38*b* are oriented towards the outside of the frame. When the deformations of the lateral uprights and their extensions by bimetallic strip effect are combined, the forces generated in the connection areas between the lateral uprights and their extensions are reduced.

As depicted in FIG. 13, in order to obtain suitable behavior of the lateral uprights, first strips 44*a* and 44*b* made from materials with a coefficient of expansion different from that of the material from which the lateral uprights are made are attached and fixed plane to plane on two faces of the lateral uprights perpendicular to the reference plane of the frame, inside the tubular upright. Blades could also be fixed to faces parallel to the reference plane, inside the uprights.

The material from which the blades 44*a* and 44*b* are made can have a coefficient of expansion greater than or less than that of the material from which the lateral uprights are made, according to the faces of the lateral uprights to which they are fixed (faces directed towards the outside of the frame, as depicted in FIGS. 13 and 14, or faces directed towards the inside).

As depicted in FIG. 13, second blades 45*a* and 45*b* can also be attached and fixed plane to plane, inside the tubular-shaped extensions, on faces of the extensions 37*a* and 37*b* of the lateral uprights perpendicular to the reference plane of the frame and directed towards the outside or towards the inside of the frame.

It is possible to fix blades ensuring a deformation of the lateral uprights on one face of the lateral uprights, or on one face of the extensions, or both on the lateral uprights and on their extensions.

So that the behavior of the extensions of the lateral uprights is reversed compared with that of the lateral uprights (with regard to the direction of the flexion resulting from heating of the frame):

- when the coefficient of expansion of the material from which the blades are made is greater than that of the material from which the extensions are made, the blades are fixed to the internal surface of the faces of the extensions directed towards the outside,
- in the contrary case, the blades are fixed to the internal surface of the faces of the extensions directed towards the inside of the frame.

In general terms, the material from which the uprights or the extensions and the blades are made, the thickness and the length of the blades and the faces of the uprights or extensions to which the blades are fixed are chosen so as to obtain the required deformation of the frame, during heating, as described above.

Any other equivalent arrangement can be envisaged by a person skilled in the art and in particular blades can be fixed to the internal surfaces of the faces of the upright and/or extensions perpendicular to the reference plane of the frame directed towards the inside or the outside of the frame. This arrangement can also be applied to the frame according to the first and second embodiments.

When the placing of the shadow mask is effected, the end uprights can be moved closer to each other, without their undergoing any deformation by flexion or with a very slight deformation.

As can be seen in FIG. 14 also, the blades 44*a*, 44*b* and 45*a*, 45*b* make it possible, during thermal cycling, to deform the uprights of the frame in opposite directions (outward flexions for the lateral uprights 33*a* and 33*b*, as depicted in solid lines, and inward flexions for the extensions 37*a* and 37*b*, as depicted in dotted lines). Because of this, the forces which are exerted in the corners of the flat frame consisting of the lateral uprights and their extensions are limited. In addition, the middle connection areas of the end uprights are little deformed or moved. The end uprights fixed by their central part in these areas are therefore little deformed and their movement produces a relaxation of the shadow mask.

In general terms, for producing shadow mask frames according to the invention, alloys with a high elastic limit and a high Young's modulus will be used. Preferably, use will be made of alloys with a low coefficient of thermal expansion in order to reduce the stresses to be applied to the frame and therefore the weight of the frame.

By comparison with a frame according to the prior art, the embodiment according to the invention makes it possible to divide the weight of the frame by at least 2.5 and also to considerably reduce the weight of glass used for manufacturing cathode ray tubes.

In particular, the flat products or alloys which can be used for manufacturing shadow mask support frames according to the invention can be one of the following types:

- alloys with a controlled coefficient of expansion of the iron-nickel type,
- structural-hardening alloys, of the type hardening by precipitation, hardening by phase transformation (martensitic, spinodal decomposition),
- alloys with a high elastic limit,
- bimetallic strips manufactured by means of two or more strips of different alloys, welded edge to edge, for the purpose of combining the physical properties of each of the alloys,
- manganese steels (11% to 30% by weight Mn), cold rolled.

It is also possible to produce frames made from steel with a high elastic limit.

The end uprights of the frame according to the invention can be produced, as described above, in the form of an angle steel with an L-shaped cross-section or in the form of a beam with a closed triangular cross-section obtained from a folded and welded metallic strip. The end uprights can also be formed from hollow profiles with a triangular cross-section. The lateral uprights of the shadow mask support frame according to the invention are generally tubular in shape with a closed cross-section, for example square or rectangular, and can be obtained by cropping and folding a metallic strip, as indicated above, or in the form of closed hollow profiled sections having a cross-section, for example, in the form of a quadrilateral (square, rectangular or trapezoidal shape) or in the form of bars.

The shadow mask support frame according to the invention generally comprises four uprights which are produced separately and connected together by embedding and connection of the plane to plane type.

The frame has, in general terms, a shape and structure making it possible to make a practically continuous closed line pass inside the uprights of the frame, in the longitudinal direction of the uprights, and along the entire periphery of the frame. However, unlike the frame according to FR-99 02129, the continuous line is not plane but has the shape of a left-hand curve.

The connection of the uprights of the frame can be effected for example by clinching, snapping on, riveting, brazing, medium-frequency resistance welding, capacitive discharge welding, crimping, adhesive bonding or screwing or by low-energy TIG or MIG welding.

Likewise, the connection of the strips, after folding in order to produce the lateral edges of the frame, can be produced by techniques other than transparency laser welding envisaged above.

The connection of the lateral uprights of the frame to the end uprights can be effected close to the longitudinal ends of the end uprights or in areas distant from the longitudinal ends in the direction of the central part of the end uprights, that is to say between a longitudinal end and the central part of the upright or in the vicinity of the central part of the upright.

When use is made, for producing lateral uprights having elbows, of thin metallic strips folded and welded, the radius of curvature of the elbows can be of the same order of magnitude as the thickness of the strip used, that is to say 0.5 to 1.5 mm.

The end connection parts of the lateral uprights can have a very slight or even zero clearance with respect to the first wall of the end upright in which they are embedded, the deformation of the end uprights being able to be obtained by plane on plane sliding of the first wall of the end uprights on the end connection parts of the lateral uprights.

The support frame for a tensioned shadow mask according to the invention can have a welding rim for the shadow mask obtained directly by folding and/or pressing, without subsequent planing of the profile.

The shadow mask frame according to the invention can be used in any colour cathode ray tube.

I claim:

1. A shadow mask support frame for a colour cathode ray tube, that is rectangular in shape overall and substantially parallel to the reference plane of the frame, having:

two substantially rectilinear end uprights parallel to each other, each end upright comprising at least one substantially plane wall perpendicular to the reference plane of the frame and having one edge which is intended to receive a shadow mask in an arrangement substantially parallel to the reference plane of the frame, and two lateral uprights that are tubular in shape overall, each having a main part with a substantially rectilinear axis and two end parts each connected to a joining portion for joining to an end upright, the joining portion being connected in an arrangement orthogonal with respect to the reference plane of the frame and parallel to the substantially plane wall of the end upright, the lateral uprights having axes parallel to each other situated in a plane parallel to the reference plane of the frame, and the joining portion having lateral faces perpendicular to the reference plane of the frame, wherein each of the joining portions is in contact through one of its lateral faces with an internal face of the substantially plane wall perpendicular to the reference plane of the frame, so that the end uprights of the frame are in abutment on the lateral faces of the joining portions of the lateral uprights.

2. A shadow mask support frame according to claim 1, in which the two end uprights each comprise at least a first substantially plane wall in the reference plane of the frame and a second wall constituting the plane wall that is substantially perpendicular to the reference plane and therefore to the first wall, having in common with the first wall an edge with a longitudinal direction of the end upright, and whose two lateral uprights comprise portions joining to the end uprights, in an orthogonal arrangement with respect to the main part of the lateral upright and perpendicular to the first wall of the end upright, and main parts having axes parallel to each other situated in a plane parallel to the reference plane of the frame, in an arrangement offset with respect to the reference plane of the frame, wherein each of the joining portions is fitted in an end upright through the first wall of the end upright and fixed against the internal face of the second wall perpendicular to the reference frame.

3. A frame according to claim 1, wherein each of the joining portions is in abutment against the internal face of the substantially flat wall of an end upright in an area of the end upright situated between a longitudinal end of the end upright and the central part of the end upright.

4. A frame according to claim 3, wherein the end parts of the lateral uprights have an elbow having a first rectilinear part substantially perpendicular to the axis of the main part of the lateral upright and a second rectilinear part constituting the joining portion perpendicular to the first rectilinear part and orthogonal to the main part of the lateral upright.

5. A frame according to claim 1, wherein each of the joining portions is in abutment against the internal face of the second substantially flat wall of an end upright in a substantially middle area, along the length of the end upright.

6. A frame according to claim 5, wherein the end parts or extensions of the lateral uprights constitute in pairs continuous uprights in the direction of the end uprights, joining the ends of the main parts of the lateral uprights in pairs in order to constitute a flat frame, each of the continuous uprights of the flat frame parallel to an end upright having at least one joining portion.

7. A frame according to claim 6, wherein each of the continuous uprights of the flat upright has two joining portions spaced apart from each other in the longitudinal direction of the continuous upright and connected together by a connection part between the extensions of the lateral uprights constituting the continuous upright.

8. A frame according to claim 6, wherein each of the continuous uprights of the flat frame has a single joining portion disposed in a middle part of the continuous upright common to the two extensions constituting the continuous upright.

9. A frame according to claim 1, wherein the end parts of the lateral portions have a rectilinear connecting portion perpendicular to the axis of the main part of the lateral upright.

10. A frame according to claim 1, wherein the lateral uprights each consist of at least one thin metallic strip folded so as to form a tube with a cross-section in the shape of a quadrilateral.

11. A frame according to claim 1, wherein the end uprights are formed by a thin metallic strip folded in the form of a hollow beam with a triangular cross-section.

12. A frame according to claim 11, wherein the end uprights in the form of beams with a triangular cross-section have a rim for fixing the shadow mask consisting of part of the second wall of the end upright folded towards the inside of the frame.

13. A frame according to claim 11, wherein the end uprights each have at least one opening passing through a first wall of the end upright in the reference plane of the frame, in an arrangement adjacent to a second wall substantially perpendicular to the first wall, in order to provide the passage of a fitted joining portion of a lateral upright of the frame.

14. A frame according to claim 13, wherein the first wall of the end uprights has at least one fixing lug along at least one of the edges of the opening produced when the opening is cut out, by folding part of the first wall of the end upright.

15. A frame according to claim 11, wherein each of the end uprights has, in a longitudinal end part, with which they are provided, a passage opening for an end part of a lateral upright of the frame and an opening passing through a first wall of the end upright in the reference plane of the frame, in an area situated at a distance from the longitudinal end of the end upright.

16. A frame according to claim 1, wherein the lateral edges of the frame consist of a metallic strip having a central part made from a first alloy with one coefficient of expansion and lateral parts with a longitudinal direction made from a second alloy having a coefficient of expansion substantially different from said one coefficient of expansion, the metallic strip being folded so as to produce the lateral upright of the frame, so that the lateral parts of the strip overlap and are fixed to each other in order to constitute a face of the lateral upright of tubular shape with a cross-section in the form of a quadrilateral.

17. A frame according to claim 1, wherein each of the lateral uprights of the frame has at least one wall with an internal surface, said at least one wall being made from a first material against the internal surface of which, that is to say a surface internal to the lateral upright, there is fixed an element made from a second material having a coefficient of expansion different from the coefficient of expansion of the first material.

18. A frame according to claim 1, wherein a first material has a coefficient of expansion and wherein a blade is provided that is made from a second material having a coefficient of thermal expansion different from the coefficient of thermal expansion of said first material, said first material constituting a wall of at least one of a lateral upright and an extension of a lateral upright is attached and fixed plane to plane, on an internal surface of a face perpendicular to the reference plane of the frame of each of the members selected from the group consisting of the lateral uprights, each of the extensions of the lateral uprights, and both each of the lateral uprights and each of the extensions so that, when the frame heats up, the lateral uprights deform by flexion in order to present a concavity directed towards the inside of the frame and the extensions deform so as to present in pairs a concavity directed towards the outside of the frame and provide a bringing together of the end uprights.

19. A frame according to claim 1, wherein the joining portions of the lateral uprights are fixed against the second wall of the end uprights, by one of the methods selected from the group consisting of riveting, clinching, snapping on, screwing, adhesive bonding, welding and brazing.

20. A frame according to claim 1, wherein the frame is formed from at least one of the following materials:

alloys with a controlled coefficient of expansion of the iron-nickel type, structural-hardening alloys, of the type hardening by precipitation, hardening by phase transformation (martensitic, spinodal decomposition), alloys with a high elastic limit, bimetallic strips manufactured by means of two or more strips of different alloys, welded edge to edge, for the purpose of combining the physical properties of each of the alloys, manganese steels, cold rolled.

21. A frame according to claim 1, wherein the frame is produced from steel with a high elastic limit.

22. A frame according to claim 1, wherein the end uprights are formed from one of the elements selected from the group consisting of hollow beam with a triangular cross-section produced by folding and welding a thin metallic strip, a profiled section with a triangular cross-section, and an L-shaped angled steel.

23. A frame according to claim 1, wherein the lateral uprights of the frame consist of one of the elements selected from the group consisting of a tube with a cross-section in the shape of a quadrilateral obtained by folding a thin metallic strip, and a hollow profiled section with a closed cross-section in the shape of a quadrilateral.

24. A frame according to claim 1, wherein the frame has a shape and structure making it possible to pass a practically continuous closed line inside the uprights of the frame in the longitudinal direction of the uprights and along the entire periphery of the frame.

25. A method of manufacturing a shadow mask support frame for a colour cathode ray tube, that is rectangular in shape overall and substantially parallel to a reference plane of the frame, having two substantially rectilinear end uprights parallel to each other, comprising at least one substantially plane wall perpendicular to the reference plane of the frame, and having one edge which is intended to receive a shadow mask in an arrangement substantially parallel to the reference plane of the frame, and two lateral uprights, that are tubular in shape overall, each having a main part with a substantially rectilinear axis and two end parts each connected to a joining portion for joining to an end upright, the joining portion being connected in an arrangement orthogonal with respect to the reference plane of the frame and parallel to the substantially plane wall of the end upright, the lateral uprights having axes parallel to each other situated in a plane parallel to the reference plane of the frame; wherein each of the joining portions is in contact through a lateral face thereof with an internal face of the substantially plane wall perpendicular to the reference plane of the frame; so that the end uprights of the frame are in abutment on the joining portions of the lateral uprights;

wherein the method consists of producing, by cropping and folding a thin metallic strip, the end uprights each having two openings passing through the first wall of the end upright, which is produced by cropping and folding the lateral uprights each having at least one end part having a joining portion; wherein the joining portions of each of the end parts of the lateral uprights are engaged in an opening passing through the first wall of an end upright, so as to fit the end parts of the lateral uprights in the uprights and to place one lateral face of the joining portion of the end parts of the lateral uprights in plane on plane contact with an internal face of a second wall of an end upright; and wherein the joining portion is fixed in plane on plane contact against the second wall of the corresponding end upright.

26. A method according to claim 25, wherein the joining portion of the end parts of the lateral uprights is fixed on the second wall of an end upright by one of the methods selected from the group consisting of riveting, clinching, snapping on, screwing, adhesive bonding, welding and brazing.

27. A method according to claim 25, wherein, after folding the thin metallic strip, to produce the end uprights and the lateral uprights of the frame, parts of the thin metallic sheet overlapping the end uprights and the lateral uprights are welded, by transparency laser beam, and wherein the fixing of the joining portions of the lateral uprights to the second walls of the end uprights is effected by transparency laser welding.

28. A method according to claim 25, wherein each of the end uprights is produced, by folding a thin metallic strip, in the form of a hollow beam with a triangular cross-section comprising the first wall, the second wall and a third wall having a third edge, the third wall being inclined with respect to the first and second walls and wherein the second wall has an external edge, which is folded above the external edge of the third wall, in order to produce a join by snapping on the second wall and the third wall and the closure of the end upright.

29. A method according to claim 25, wherein, prior to the folding of the thin metallic strip, for producing the lateral uprights, there are fixed, plane on plane, on certain parts of the thin metallic strip intended to constitute, after folding, internal surfaces of the wall of the lateral uprights, thin strips made from an alloy having a coefficient of thermal expansion different from the coefficient of thermal expansion of the thin metallic strip.

30. A method according to claim 29, wherein said thin strips are fixed by welding.

* * * * *

UNITED STATES PATENT AND TRADEMARK OFFICE

CERTIFICATE OF CORRECTION

PATENT NO. : 6,703,774 B2
DATED : March 9, 2004
INVENTOR(S) : Jean-Pierre Reyal

It is certified that error appears in the above-identified patent and that said Letters Patent is hereby corrected as shown below:

Title page,
Insert Item:
-- [30] Foreign Application Priority Data
04/03/2001 (FR) 01 04527
10/30/2001 (FR) 01 14066 --

Signed and Sealed this

Twenty-fifth Day of May, 2004

JON W. DUDAS
*Acting Director of the United States Patent and Trademark Office*